US009622004B2

(12) United States Patent
Matsumoto et al.

(10) Patent No.: US 9,622,004 B2
(45) Date of Patent: Apr. 11, 2017

(54) SOUND VELOCITY CORRECTION DEVICE

(71) Applicant: PANASONIC INTELLECTUAL PROPERTY MANAGEMENT CO., LTD., Osaka (JP)

(72) Inventors: Hiroyuki Matsumoto, Fukuoka (JP); Shuichi Watanabe, Fukuoka (JP); Hisashi Tsuji, Fukuoka (JP); Akitoshi Izumi, Fukuoka (JP); Hirotaka Sawa, Fukuoka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/798,781

(22) Filed: Jul. 14, 2015

(65) Prior Publication Data

US 2016/0021474 A1 Jan. 21, 2016

(30) Foreign Application Priority Data

Jul. 15, 2014 (JP) ..... 2014-145367

(51) Int. Cl.
*H04R 29/00* (2006.01)
*H04R 1/40* (2006.01)
*H04R 3/00* (2006.01)

(52) U.S. Cl.
CPC ..... *H04R 29/005* (2013.01); *H04R 1/406* (2013.01); *H04R 3/005* (2013.01)

(58) Field of Classification Search
CPC ..... H04R 29/005; H04R 1/406; H04R 3/005
See application file for complete search history.

(56) References Cited

U.S. PATENT DOCUMENTS 5,624,188 A * 4/1997 West ..... G01K 11/24 374/119
7,995,770 B1 8/2011 Simon
2002/0191802 A1 12/2002 Choe et al.
2006/0215854 A1 9/2006 Suzuki et al.
2008/0037803 A1 2/2008 Breed
2012/0189128 A1 7/2012 Maillard et al.
(Continued)

FOREIGN PATENT DOCUMENTS

JP 7-131885 5/1995
JP 8-286680 11/1996
(Continued)

OTHER PUBLICATIONS

The Extended European Search Report dated Oct. 23, 2015 for the related European Patent Application No. 15175324.1.

*Primary Examiner* — Muhammad N Edun
(74) *Attorney, Agent, or Firm* — Greenblum & Bernstein, P.L.C.

(57) ABSTRACT

Provided a sound velocity correction device including an environmental parameter obtainer that acquires a measured value of a surrounding environmental parameter of a sound collector that collects a sound emitted from a sound source; and a sound velocity corrector that corrects a sound velocity of the sound which is used to form directivity in a directing direction toward the sound source from the sound collector, using the measured value of the surrounding environmental parameter of the sound collector which is acquired by the environmental parameter obtainer.

14 Claims, 39 Drawing Sheets

(56) References Cited

U.S. PATENT DOCUMENTS

2015/0194799 A1* 7/2015 Ishii ..... H04R 3/007
361/103

FOREIGN PATENT DOCUMENTS

| | | |
|---|---|---|
| JP | 10-070786 | 3/1998 |
| JP | 2005-121474 | 5/2005 |
| JP | 2008-170155 | 7/2008 |
| JP | 2009-188617 | 8/2009 |
| JP | 2013-090289 | 5/2013 |
| WO | 2010/077245 | 7/2010 |

* cited by examiner

SOUND VELOCITY CORRECTION DEVICE

BACKGROUND

1. Technical Field

The present disclosure relates to a sound velocity correction device that corrects a sound velocity used in forming directivity of a sound in a direction toward a sound source from a microphone array device.

2. Description of the Related Art

In a monitoring system installed at a predetermined position (for example, a ceiling) in a factory, a store (for example, a retail store or a bank), or a public place (for example, a library), a wide viewing angle of video data (including a still image and a movie, the same applies hereinafter) in a predetermined range of a monitoring target is achieved by connecting a plurality of camera devices (for example, pan tilt camera devices or omnidirectional camera devices) to each other through a network.

Since the amount of information obtained is inevitably limited in monitoring only for a video, there is a strong demand for a monitoring system that obtains sound data in a direction in which a camera device captures a specific subject by disposing not only the camera device but also a microphone array device.

Hitherto, in a beam forming process (directivity forming process) for forming directivity in a specific direction with respect to sound data related to sounds collected by a microphone array device including a plurality of microphone elements, a sound velocity used to calculate a delay time necessary for the directivity forming process has been treated as a fixed value. For this reason, when a sound velocity changes due to, for example, changes in air temperature, the accuracy of directivity formed in the directivity forming process deteriorates.

Here, as the related art in which an adjustment value for setting a time difference between sound waves reaching microphones from a sound source to be zero is calculated using a temperature value of a propagation path of the sound waves from the sound source, for example, an image display device disclosed in Japanese Patent Unexamined Publication No. 2013-90289 is known.

The image display device disclosed in Japanese Patent Unexamined Publication No. 2013-90289 includes a microphone group, a sound source position calculation means, a test sound wave generation means, and an adjustment value calculation means. The microphone group includes a plurality of microphones for detecting sound waves emitted from a sound source. The sound source position calculation means calculates the position of a sound source on the basis of a time difference between sound waves reaching each microphone group. The test sound wave generation means are disposed at a position separated from the microphones at equal distances and emit white noise including sound waves having a plurality of different frequencies as sound waves. The adjustment value calculation means calculates a time difference between sound waves having a plurality of different frequencies reaching a microphone group for each frequency on the basis of the position of the test sound wave generation means which is calculated by the sound source position calculation means, and collectively calculates adjustment values for the respective frequencies for making phases of signals of sound waves detected by the microphone group conform to each other so as to set the time difference to be zero. Meanwhile, in Japanese Patent Unexamined Publication No. 2013-90289, an ambient temperature value used to correct propagation velocities of sound waves emitted from a sound source is a value which is input from a keyboard by a user.

SUMMARY

An object of the disclosure is to provide a sound velocity correction device that suppresses deterioration in directivity formation accuracy by acquiring at least ambient temperature, humidity, and atmospheric pressure at the time of collecting a sound emitted from a sound source in a specific direction when seen from a microphone array device and by calculating an accurate sound velocity.

According to an aspect of the disclosure, there is provided a sound velocity correction device including an environmental parameter obtainer that acquires a measured value of a surrounding environmental parameter of a sound collector that collects a sound emitted from a sound source; and a sound velocity corrector that corrects a sound velocity of the sound which is used to form directivity in a directing direction toward the sound source from the sound collector, using the measured value of the surrounding environmental parameter of the sound collector which is acquired by the environmental parameter obtainer.

According to the disclosure, it is possible to suppress deterioration in directivity formation accuracy by acquiring at least ambient temperature, humidity, and atmospheric pressure at the time of collecting a sound emitted from a sound source in a specific direction when seen from a microphone array device and by calculating an accurate sound velocity.

DETAILED DESCRIPTION OF THE PREFERRED EMBODIMENTS

Hereinafter, exemplary embodiments of a directivity control system including a sound velocity correction device according to the disclosure will be described with reference to the accompanying drawings. The directivity control system according to each exemplary embodiment is used as a monitoring system (including a manned monitoring system and an unmanned monitoring system) which is installed in, for example, a factory, a public facility (for example, a library or an even hall), or a store (for example, a retail store or a bank), but the disclosure is not particularly limited thereto. In the following exemplary embodiments, a description is given on the assumption that the directivity control system according to each exemplary embodiment is installed in, for example, a store. In the following exemplary embodiments, a sound velocity correction device according to the disclosure is equivalent to an omnidirectional microphone array device or a directivity control device.

Meanwhile, the disclosure can also be expressed as each device (for example, a directivity control device or an omnidirectional microphone array device to be described later) which constitutes the directivity control system or a method including operations (steps) performed by each device (for example, a directivity control device or an omnidirectional microphone array device to be described later) which constitutes the directivity control system.

First Exemplary Embodiment

Figure 1:
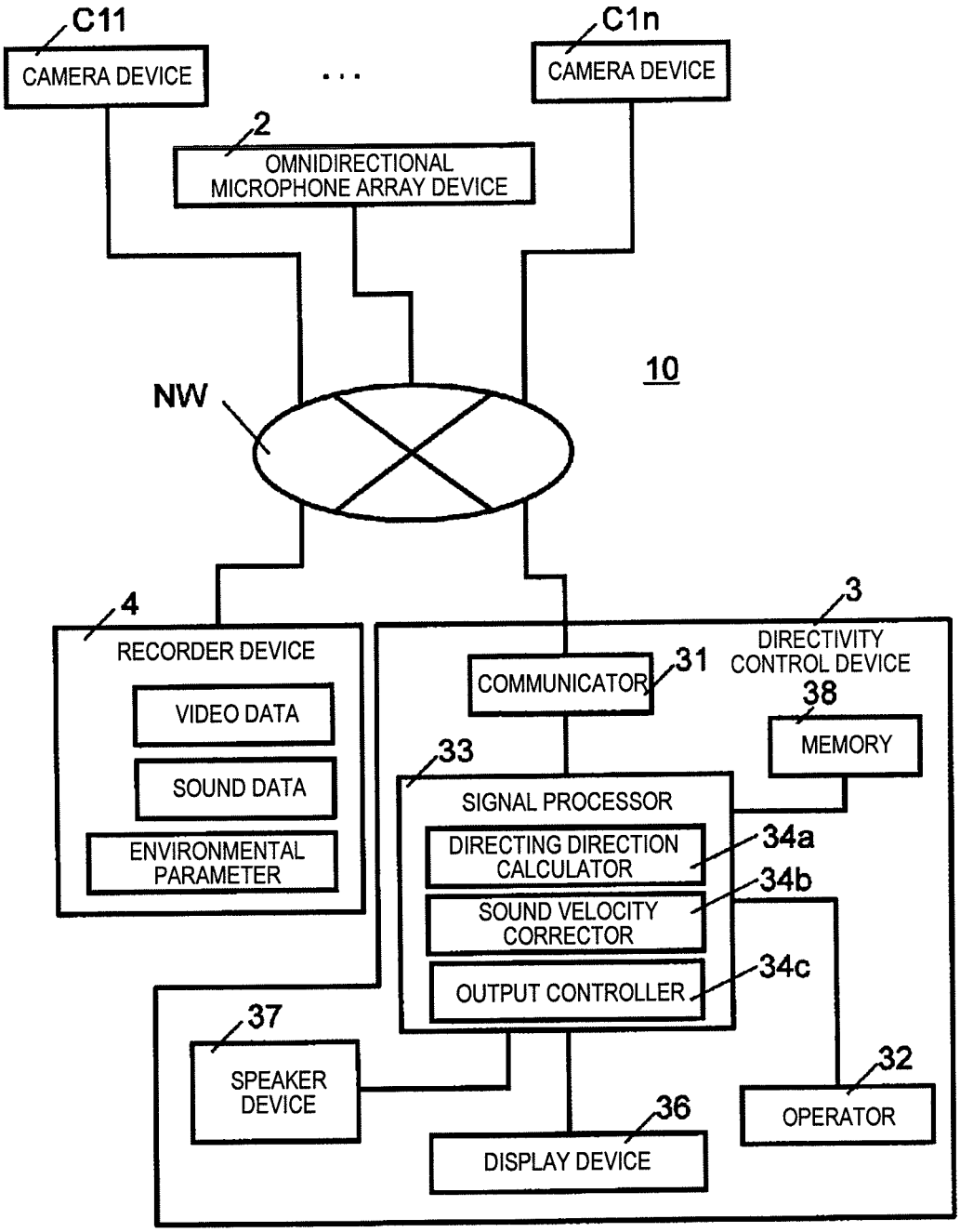
FIG. 1 is a block diagram illustrating a system configuration of a directivity control system according to a first exemplary embodiment.

FIG. 1 is a block diagram illustrating a system configuration of directivity control system 10 according to a first exemplary embodiment. Directivity control system 10 illustrated in FIG. 1 is configured to include omnidirectional microphone array device 2, camera devices C11, . . . , and C1*n*, directivity control device 3, and recorder device 4. Omnidirectional microphone array device 2 collects a sound in a sound collection region in which directivity control system 10 is installed, and collects, for example, a sound (for example, a conversation sound of person HM) which is emitted by a person (for example, see person HM of FIG. 13A) as an example of a sound source which is present in a sound collection region.

Omnidirectional microphone array device 2 includes plate-like microphone housing 125 (see FIGS. 5A and 5B) which has a concentric dish shape having central concave portion 135 formed in the center thereof, for example, as an example of a sound collector accommodating housing to be described later, and collects sounds from directions in 360-degrees (all directions) centering on an installation position of omnidirectional microphone array device 2. A dish shape is described as the shape of the housing of omnidirectional microphone array device 2 according to the present exemplary embodiment, but the disclosure is not limited to the dish shape. For example, a doughnut shape or a ring shape (see FIGS. 2A to 2E) may be used.

In omnidirectional microphone array device 2, a plurality of microphone units 22 are concentrically disposed in the vicinity of central concave portion 135 and along a circumferential direction of plate-like microphone housing 125. For example, non-directional electret condenser microphone (ECM) 117*a* having high sound quality and a small size is used as microphone unit 22 as an example of a sound collector, and the same is true of the following exemplary embodiments.

In directivity control system 10 illustrated in FIG. 1, omnidirectional microphone array device 2, directivity control device 3, and recorder device 4 are connected to each other through network NW. Network NW may be a wired network (for example, an intranet or the Internet) or may be a wireless network (for example, a wireless local area network (LAN)), and the same is true of the following exemplary embodiments.

Camera devices C11, . . . , and C1*n* as examples of imaging units are installed so as to be fixed to, for example, a ceiling of an event hall. Each of camera devices C11, . . . , and C1*n* has a function as a monitoring camera, for example, in a monitoring system and captures a predetermined video using a zoom function (for example, zoom-in processing and zoom-out processing) and an optical axis moving function (panning and tilting) through a remote operation from a monitoring control room (not shown) which is connected to network NW. Installation positions and installation directions of the respective camera devices are registered in directivity control device 3. Pieces of data regarding panning, tilting, and zooming information are transmitted to directivity control device 3 when necessary, and an image position and the directing direction are always associated with each other. For example, when camera device C11 is an omnidirectional camera, image data (that is, omnidirectional image data) indicating an omnidirectional video of a sound collection region and plane image data generated by performing predetermined distortion correction processing on omnidirectional image data and then performing panorama conversion thereon are transmitted to directivity control device 3 or recorder device 4 through network NW. Hereinafter, a case where camera device C11 is an omnidirectional camera will be described.

In an image displayed on display device 36, when any position is designated by a user, camera device C11 receives coordinate data of the designated position in the image from directivity control device 3, calculates data of a distance between camera device C11 and a sound position (hereinafter, simply referred to as a "sound position") on a real space corresponding to the designated position and the direction therebetween (including a horizontal angle and a vertical angle, the same applies hereinafter), and transmits the calculated data to directivity control device 3. Meanwhile, since a process of calculating data of a distance and a direction in camera device C11 is a known technique, a description thereof will be omitted here.

Omnidirectional microphone array device 2 is connected to network NW, and is configured to include at least microphone elements 221, 222, . . . , and 22*n* disposed at equal intervals and controller 281 (see FIG. 4) which performs predetermined signal processing on sound data of sounds collected by the respective microphone elements. A detailed configuration of omnidirectional microphone array device 2 will be described later with reference to, for example, FIG. 4.

Omnidirectional microphone array device 2 transmits sound data of sounds collected by microphone units 22 and 23 to directivity control device 3 or recorder device 4 through network NW. Omnidirectional microphone array device 2 detects (measures) surrounding environmental parameters (for example, at least temperature among parameters including temperature, humidity, atmospheric pressure, a wind direction, and a wind velocity) during the collection of sounds and transmits measured values of the respective environmental parameters which are included in the same packet PKT (see FIG. 6A) as the sound data to directivity control device 3 or recorder device 4.

Directivity control device 3 calculates (corrects) sound velocity Vs (see FIG. 3) which is used when directivity is formed in the directing direction (to be described later) corresponding to a position (designated position) designated from operator 32 by a user's operation, using sound data transmitted from omnidirectional microphone array device 2 and a measured value of an environmental parameter, and forms the directivity of the sound data in the directing direction ($\theta_{MAh}$, $\theta_{MAv}$) using sound velocity Vs after the calculation is performed (correction). Thereby, directivity control device 3 can make a sound volume level of a sound collected from the directing direction ($\theta_{MAh}$, $\theta_{MAv}$) in which directivity is formed higher than a sound volume level of a sound collected from another direction. Meanwhile, since a method of calculating the directing direction ($\theta_{MAh}$, $\theta_{MAv}$) is a known technique, a detailed description thereof will be omitted in the present exemplary embodiment.

FIGS. 2A to 2E are diagrams illustrating exteriors of omnidirectional microphone array devices 2A, 2B, 2C, 2D, and 2E. Omnidirectional microphone array devices 2A, 2B, 2C, 2D, and 2E illustrated in FIGS. 2A to 2E have different exteriors and arrangement positions of a plurality of microphone units 22 and 23, but have the same function.

Figure 2A:
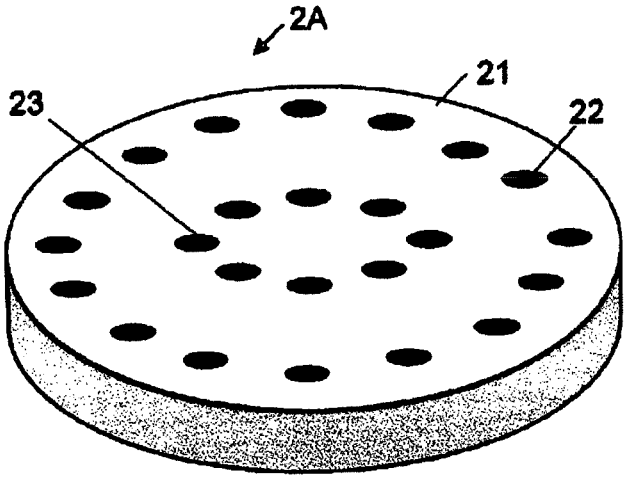
FIG. 2A is a diagram illustrating the exterior of an omnidirectional microphone array device.

Omnidirectional microphone array device 2A illustrated in FIG. 2A includes disk-like housing 21. A plurality of microphone units 22 and 23 are concentrically disposed in housing 21. Specifically, a plurality of microphone units 22 are concentrically disposed along a large circular shape having the same center as housing 21, and a plurality of microphone units 23 are concentrically disposed along a small circular shape having the same center as housing 21. A plurality of microphone units 22 have large intervals therebetween, have a large diameter, and have characteristics suitable for a narrow sound range. On the other hand, a plurality of microphone units 23 have small intervals therebetween, have a small diameter, and have characteristics suitable for a wide sound range.

Figure 2B:
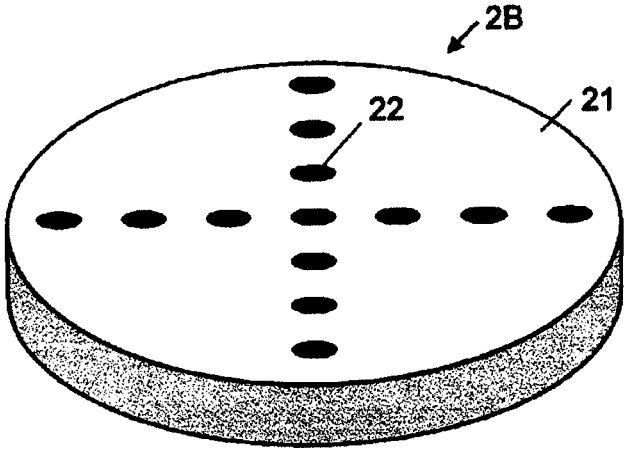
FIG. 2B is a diagram illustrating the exterior of an omnidirectional microphone array device.

Omnidirectional microphone array device 2B illustrated in FIG. 2B includes disk-like housing 21. A plurality of microphone units 22 are disposed on a straight line at equal intervals in housing 21, and are disposed in such a manner that the centers of plurality of microphone units 22 disposed in a vertical direction and the centers of plurality of microphone units 22 disposed in a horizontal direction intersect each other in the center of housing 21. In omnidirectional microphone array device 2B, a plurality of microphone units 22 are disposed in the form of vertical and horizontal straight lines, and thus it is possible to reduce the amount of computation in a process of forming the directivity of sound data. Meanwhile, a plurality of microphone units 22 may be disposed in a single line in the vertical direction or the horizontal direction.

Figure 2C:
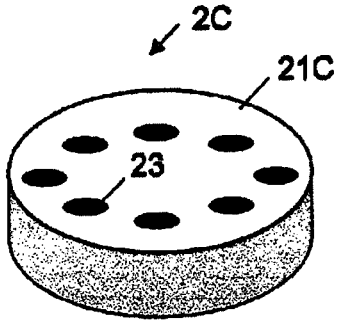
FIG. 2C is a diagram illustrating the exterior of an omnidirectional microphone array device.

Omnidirectional microphone array device 2C illustrated in FIG. 2C includes disk-like housing 21C having a smaller diameter than that of omnidirectional microphone array device 2A illustrated in FIG. 2A. A plurality of microphone units 23 are equally disposed along a circumferential direction in housing 21C. Omnidirectional microphone array device 2C illustrated in FIG. 2C has small intervals between microphone units 23 thereof and has characteristics suitable for a wide sound range.

Figure 2D:
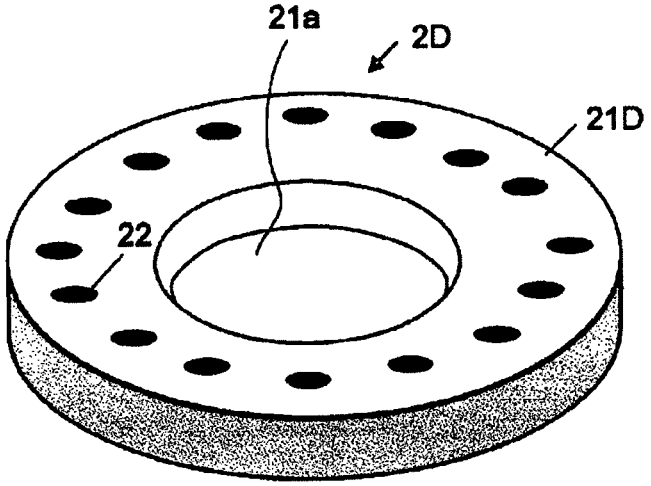
FIG. 2D is a diagram illustrating the exterior of an omnidirectional microphone array device.

Omnidirectional microphone array device 2D illustrated in FIG. 2D includes doughnut- or ring-shaped housing 21D in which opening 21*a* having a predetermined size is formed in the center thereof. In housing 21D, a plurality of microphone units 22 are concentrically disposed at equal intervals in the circumferential direction of housing 21D.

Figure 2E:
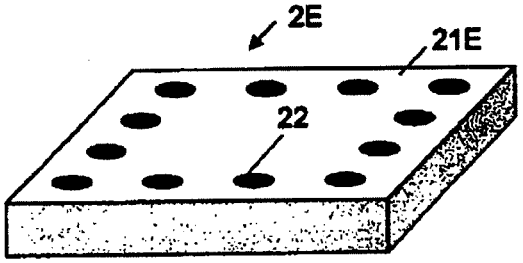
FIG. 2E is a diagram illustrating the exterior of an omnidirectional microphone array device.

Omnidirectional microphone array device 2E illustrated in FIG. 2E includes rectangular housing 21E. A plurality of microphone units 22 are disposed in housing 21E at equal intervals along the outer circumferential direction of housing 21E. In omnidirectional microphone array device 2E illustrated in FIG. 2E, housing 21E is formed in a rectangular shape, and thus it is possible to simplify the installation of omnidirectional microphone array device 2E, for example, even at a place such as, for example, a corner.

Directivity control device 3 is connected to network NW, and may be a stationary personal computer (PC) installed in, for example, a monitoring system control room (not shown), or may be a user's portable data communication terminal such as a mobile phone, a tablet terminal, or a smartphone.

Directivity control device 3 is configured to include at least communicator 31, operator 32, signal processor 33, display device 36, speaker device 37, and memory 38. Signal processor 33 is configured to include at least directing direction calculator 34*a*, sound velocity corrector 34*b*, and output controller 34*c*.

Communicator 31 receives packet PKT (for example, see FIG. 6A) which is transmitted from omnidirectional microphone array device 2 through network NW and outputs the received packet to signal processor 33.

Operator 32 is a user interface (UI) for notifying signal processor 33 of contents of a user's operation, and is a pointing device such as, for example, a mouse or a keyboard. Operator 32 is disposed corresponding to, for example, a screen of display device 36, and may be configured using a touch panel or a touch pad which is operable by a user's finger or a stylus pen.

Operator 32 acquires coordinate data indicating a position (that is, a position at which a sound volume level of a sound output from speaker device 37 is desired to be increased or decreased) which is designated by a user's operation, with respect to an image (that is, an image captured by one camera device selected among camera devices C11, . . . , and C1*n*, the same applies hereinafter) which is displayed on display device 36, and outputs the acquired coordinate data to signal processor 33.

Signal processor 33 is configured using, for example, a central processing unit (CPU), a micro processing unit (MPU), or a digital signal processor (DSP), and performs control processing for controlling operations of units of directivity control device 3 as a whole, data input and output processing with other units, data computation (calculation) processing, and data storage processing.

Directing direction calculator 34*a* calculates coordinates ($\theta_{MAh}$, $\theta_{MAv}$) indicating the directing direction toward a sound position (for example, a position of person HM illustrated in FIG. 13A, hereinafter referred to as a "sound position") which corresponds to a designated position from omnidirectional microphone array device 2 in accordance with a user's operation of designating a position from an image displayed on display device 36. A specific calculating method of directing direction calculator 34*a* is a known technique as described above, and thus a detailed description thereof will be omitted here.

Directing direction calculator 34*a* calculates directing direction coordinates ($\theta_{MAh}$, $\theta_{MAv}$) toward a sound position from the installation position of omnidirectional microphone array device 2 using data of a distance between the installation position of camera device C11 and a sound position and the direction therebetween. For example, when the housing of omnidirectional microphone array device 2 and camera device C11 are integrally installed so as to surround the housing of camera device C11, a direction (horizontal angle, vertical angle) between camera device C11 and the sound position can be used as directing direction coordinates ($\theta_{MAh}$, $\theta_{MAv}$) between omnidirectional microphone array device 2 and the sound position. Meanwhile, when the housing of camera device C11 and the housing of omnidirectional microphone array device 2 are installed at separate locations, directing direction calculator 34*a* calculates directing direction coordinates ($\theta_{MAh}$, $\theta_{MAv}$) between omnidirectional microphone array device 2 and the sound position using data of a calibration parameter calculated in advance and data of a direction (horizontal angle, vertical angle) between camera device C11 and the sound position. Meanwhile, the calibration is an operation of calculating or acquiring a predetermined calibration parameter required for directing direction calculator 34*a* of directivity control device 3 to calculate coordinates ($\theta_{MAh}$, $\theta_{MAv}$) indicating the directing direction, and is assumed to be performed in advance by a known technique.

In the coordinates ($\theta_{MAh}$, $\theta_{MAv}$) indicating the directing direction, $\theta_{MAh}$ denotes a horizontal angle in the directing direction toward a sound position from omnidirectional microphone array device 2, and $\theta_{MAv}$ denotes a vertical angle in the directing direction toward a sound position from omnidirectional microphone array device 2. Meanwhile, the sound position is a position of the site serving as an actual monitoring target or a sound collection target corresponding to a designated position designated from operator 32 by a user's finger or a stylus pen in an image displayed on display device 36 (see FIG. 13A).

Sound velocity corrector 34*b* calculates or corrects sound velocity Vs which is a propagation velocity of a sound when omnidirectional microphone array device 2 collects a sound, using environmental parameter data PDT included in packet PKT transmitted from omnidirectional microphone array device 2. Methods of calculating and correcting sound velocity Vs in sound velocity corrector 34*b* will be described later in detail.

Output controller 34*c* controls operations of display device 36 and speaker device 37, displays image data transmitted from camera device C11, for example, by a user's operation on display device 36, and causes sound data included in packet PKT transmitted from omnidirectional microphone array device 2 to be output from speaker device 37. Output controller 34*c* as an example of a directivity formation unit forms the directivity of sound data collected by omnidirectional microphone array device 2 in the directing direction which is indicated by the coordinates ($\theta_{MAh}$, $\theta_{MAv}$) calculated by directing direction calculator 34*a*, but may form directivity in omnidirectional microphone array device 2.

Display device 36 as a display displays image data transmitted from, for example, camera device C11 on the screen under the control of output controller 34*c*, for example, by a user's operation.

Speaker device 37 as a sound output outputs sound data included in packet PKT transmitted from omnidirectional microphone array device 2, or sound data in which directivity is formed in the directing direction which is indicated by coordinates ($\theta_{MAh}$, $\theta_{MAv}$) calculated by directing direction calculator 34*a*. Meanwhile, display device 36 and speaker device 37 may be separately configured from directivity control device 3.

Memory 38 as a storage is configured using, for example, a random access memory (RAM), functions as a work memory when units of directivity control device 3 operate, and stores data required when units of directivity control device 3 operate.

Recorder device 4 stores sound data included in packet PKT transmitted from omnidirectional microphone array device 2 and environmental parameter data PDT in association with image data transmitted from, for example, camera device C11. Meanwhile, since directivity control system 10 illustrated in FIG. 1 includes a plurality of camera devices, recorder device 4 may store pieces of image data transmitted from the respective camera devices in association with sound data included in packet PKT transmitted from omnidirectional microphone array device 2 and environmental parameter data PDT. The type of data stored in recorder device 4 will be described later with reference to, for example, FIG. 7A.

Figure 3:
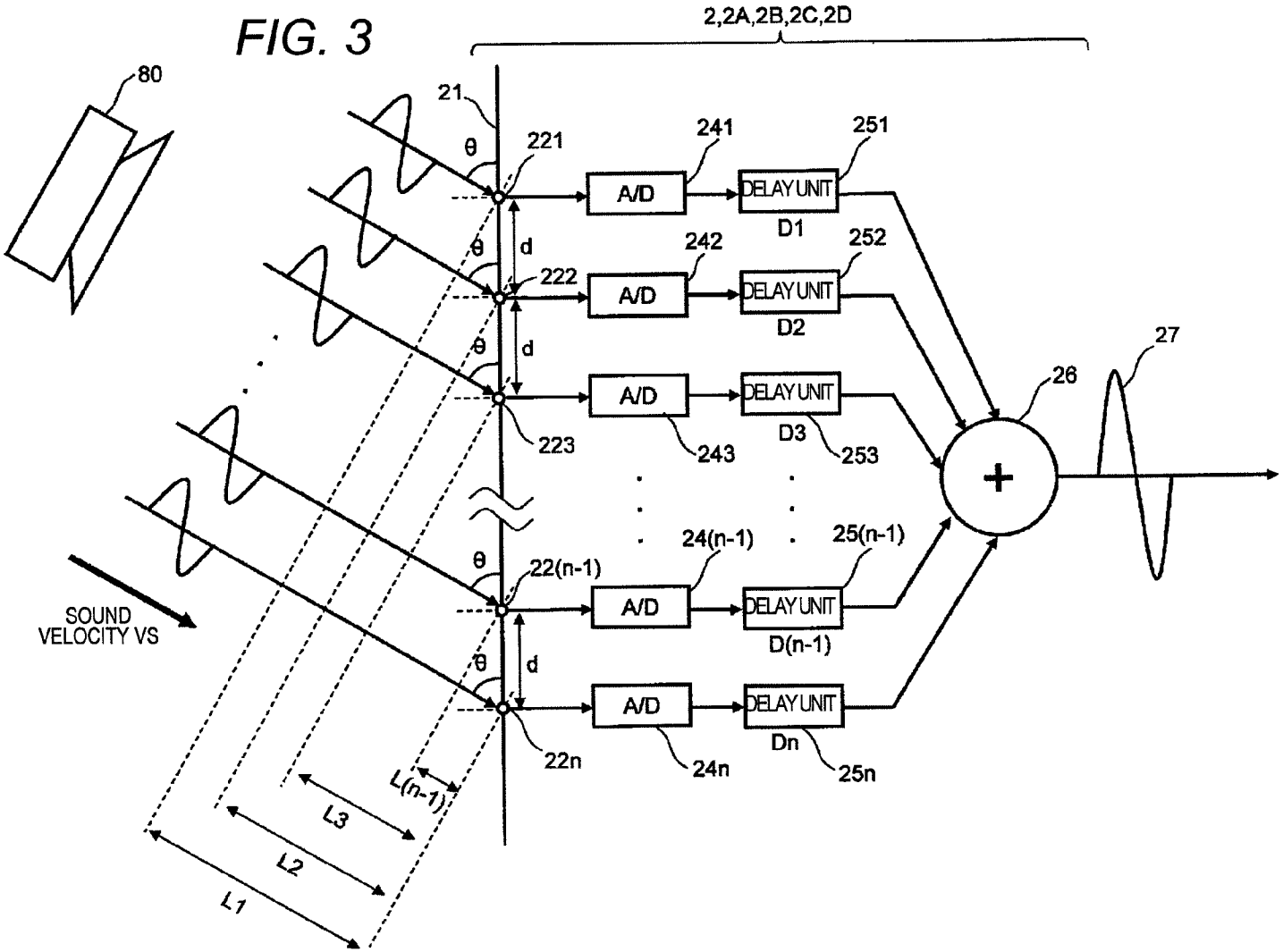
FIG. 3 is a diagram illustrating an example of a principle in which directivity is formed in direction θ with respect to a sound collected by an omnidirectional microphone array device.

FIG. 3 is a diagram illustrating an example of a principle by which directivity is formed in direction θ with respect to a sound collected by omnidirectional microphone array device 2. In FIG. 3, the principle of a directivity forming process using, for example, a delay sum method will be briefly described. Sound waves emitted from sound source 80 are incident on microphone elements 221, 222, 223, . . . , 22(*n*−1), and 22*n* built into microphone units 22 and 23 of omnidirectional microphone array device 2 at a fixed angle (incident angle=(90−θ) [degrees]). Incident angle θ illustrated in FIG. 3 may be horizontal angle $\theta_{MAh}$ or vertical angle $\theta_{MAv}$ in a sound collection direction toward a sound position from omnidirectional microphone array device 2.

Sound source 80 is a subject (for example, person HM illustrated in FIG. 13A) of a camera device which is present, for example, in a direction in which omnidirectional microphone array device 2 collects sound, and is present on the surface of housing 21 of omnidirectional microphone array device 2 in a direction having predetermined angle θ. Intervals d between microphone elements 221, 222, 223, . . . , 22(*n*−1), and 22*n* are set to be fixed.

The sound waves emitted from sound source 80 are first collected by reaching microphone element 221 and are then collected by reaching microphone element 222. Similarly, the sound waves are successively collected, and are finally collected by reaching microphone element 22*n*.

Meanwhile, a direction toward sound source 80 from the positions of microphone elements 221, 222, 223, . . . , 22(*n*−1), and 22*n* of omnidirectional microphone array device 2 is the same as a direction toward a sound position corresponding to a designated position, which is designated on the screen of display device 36 by a user, from the microphone elements of omnidirectional microphone array device 2, for example, when sound source 80 is a sound during the conversation of person HM.

Here, arrival time differences τ1, τ2, τ3, . . . , and τn−1 occur between a time when sound waves reach microphone elements 221, 222, 223, . . . , and 22(*n*−1) and a time when the sound waves reach microphone element 22*n* having finally collected a sound. For this reason, when pieces of sound data collected by microphone elements 221, 222, 223, . . . , 22(*n*−1), and 22*n* are added up as they are, the pieces of sound data are added up with the phases thereof shifted, and thus sound volume levels of the sound waves weaken each other overall.

Meanwhile, τ1 is time of a difference between a time when sound waves reach microphone element 221 and a time when the sound waves reach microphone element 22*n*, and τ2 is time of a difference between a time when sound waves reach microphone element 222 and a time when the sound waves reach microphone element 22*n*. Similarly, τn−1 is time of a difference between a time when sound waves reach microphone element 22(*n*−1) and a time when the sound waves reach microphone element 22*n*.

In the directivity forming process according to the present exemplary embodiment, A/D converters 241, 242, 243, . . . , 24(*n*−1), and 24*n* provided corresponding to microphone elements 221, 222, 223, . . . , 22(*n*−1), and 22*n* convert an analog sound signal into a digital sound signal. Further, predetermined delay times of the digital sound signal are added up by delay units 251, 252, 253, . . . , 25(*n*−1), and 25*n* provided corresponding to microphone elements 221, 222, 223, . . . , 22(*n*−1), and 22*n*. Outputs of delay units 251, 252, 253, . . . , 25(*n*−1), and 25*n* are added up by adder 26.

Meanwhile, when the directivity forming process is performed by omnidirectional microphone array device 2, delay units 251, 252, 253, . . . , 25(*n*−1), and 25*n* are provided in omnidirectional microphone array device 2. When the directivity forming process is performed by directivity control device 3, delay units 251, 252, 253, . . . , 25(*n*−1), and 25*n* are provided in directivity control device 3.

Further, in the directivity forming process illustrated in FIG. 3, delay units 251, 252, 253, . . . , 25(*n*−1), and 25*n* apply delay times corresponding to arrival time differences in respective microphone elements 221, 222, 223, . . . , 22(*n*−1), and 22*n* to arrange the phases of all sound waves. Then, pieces of sound data after the delay processing are added up by adder 26. Thereby, omnidirectional microphone array device 2 or directivity control device 3 can form directivity in a direction of angle θ with respect to sounds collected by respective microphone elements 221, 222, 223, . . . , 22(*n*−1), and 22*n*.

For example, in FIG. 3, delay times D1, D2, D3, . . . , D(n−1), and Dn applied by respective delay units 251, 252, 253, . . . , 25(*n*−1), and 25*n* are equivalent to arrival time differences τ1, τ2, τ3, . . . , and τ(n−1), respectively, and are expressed as Expression (1).

$$D1 = \frac{L1}{Vs} = \frac{\{d \times (n-1) \times \cos\theta\}}{Vs}$$

$$D2 = \frac{L2}{Vs} = \frac{\{d \times (n-2) \times \cos\theta\}}{Vs}$$

$$D3 = \frac{L3}{Vs} = \frac{\{d \times (n-3) \times \cos\theta\}}{Vs},$$

$$\ldots,$$

$$Dn-1 = \frac{Ln-1}{Vs} = \frac{\{d \times 1 \times \cos\theta\}}{Vs}$$

$$Dn = 0 \ldots (1)$$

Here, L1 denotes a difference in sound wave arrival distance between microphone element 221 and microphone element 22*n*. In addition, L2 denotes a difference in sound wave arrival distance between microphone element 222 and microphone element 22*n*. Further, L3 denotes a difference in sound wave arrival distance between microphone element 223 and microphone element 22*n*. Similarly, L(n−1) denotes a difference in sound wave arrival distance between microphone element 22(*n*−1) and microphone element 22*n*. In addition, Vs denotes the sound velocity of a sound wave. Sound velocity Vs may be calculated by omnidirectional microphone array device 2, or may be calculated by directivity control device 3 (to be described later). Here, L1, L2, L3, . . . , and L(n−1) are known values. In FIG. 3, delay time Dn set in delay unit 25*n* is 0 (zero).

In the directivity forming process, delay times Di (i is an integer of 1 to n, n is an integer of 2 or more) which are applied to pieces of sound data of the sounds collected by the respective microphone elements are inversely proportional to sound velocity Vs expressed as Expression (1). As described later, sound velocity Vs changes depending on temperature, humidity (water vapor pressure), or atmospheric pressure, or depending on a wind velocity when necessary. Accordingly, in order to form highly accurate directivity, the microphone elements need to perform conversion (correction) into accurate sound velocity Vs using environmental parameters (for example, temperature, water vapor pressure (humidity), atmospheric pressure, and a wind velocity) at the time of collecting a sound.

In this manner, omnidirectional microphone array device 2 or directivity control device 3 can easily and arbitrarily form the directivity of sound data of sounds collected by respective microphone elements 221, 222, 223, . . . , 22(*n*−1), and 22*n* built into microphone unit 22 or microphone unit 23 by changing delay times D1, D2, D3, . . . , Dn−1, and Dn applied by delay units 251, 252, 253, . . . , 25(*n*−1), and 25*n*.

Figure 4:
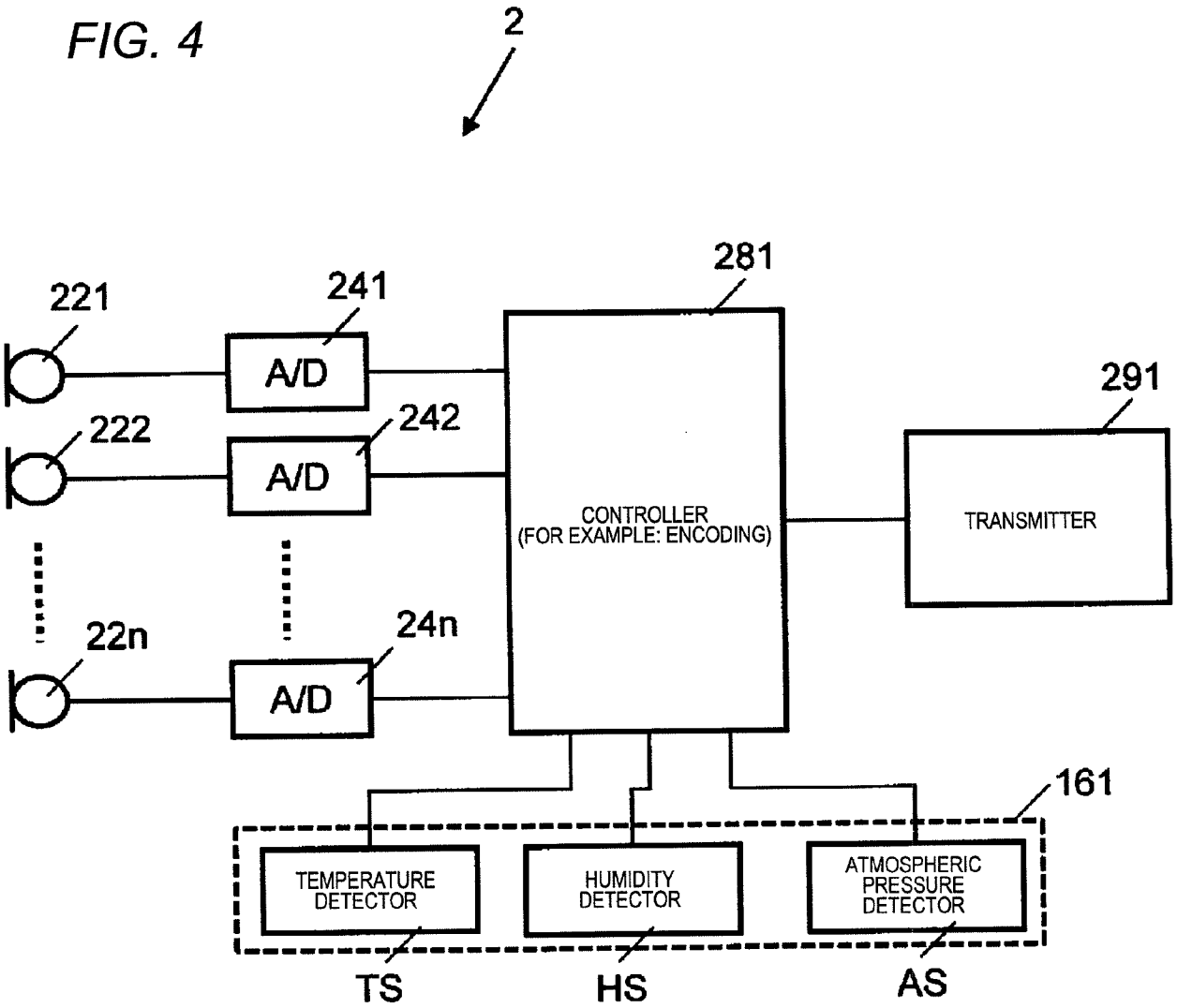
FIG. 4 is a block diagram illustrating a first example of an internal configuration of an omnidirectional microphone array device.

FIG. 4 is a block diagram illustrating a first example of an internal configuration of omnidirectional microphone array device 2. Omnidirectional microphone array device 2 illustrated in FIG. 4 is configured to include a plurality of microphone elements 221, 222, . . . , and 22*n*, A/D converters 241, 242, . . . , and 24*n* provided corresponding to respective microphone elements 221, 222, . . . , and 22*n*, controller 281, transmitter 291, temperature detector TS, humidity detector HS, and atmospheric pressure detector AS.

Microphone elements 221, 222, . . . , and 22*n* collect sound in a sound collection region. Analog sound signals of sounds collected by microphone elements 221, 222, . . . , and 22*n* are converted into digital sound signals by A/D converters 241, 242, . . . , and 24*n* and are input to controller 281.

Controller 281 performs control processing for controlling operations of units of omnidirectional microphone array device 2 as a whole, data input and output processing with other units, data computation (calculation) processing, and data storage processing. For example, controller 281 performs encoding of the input digital sound signals and data including measured values of temperature, humidity (water vapor pressure), and atmospheric pressure, as environmental parameters, which are detected (measured) by temperature detector TS, humidity detector HS, and atmospheric pressure detector AS, and outputs the encoded signals and data to transmitter 291. Transmitter 291 generates packet PKT from the encoded data and transmits the generated packet to directivity control device 3 and recorder device 4.

Figure 6A:
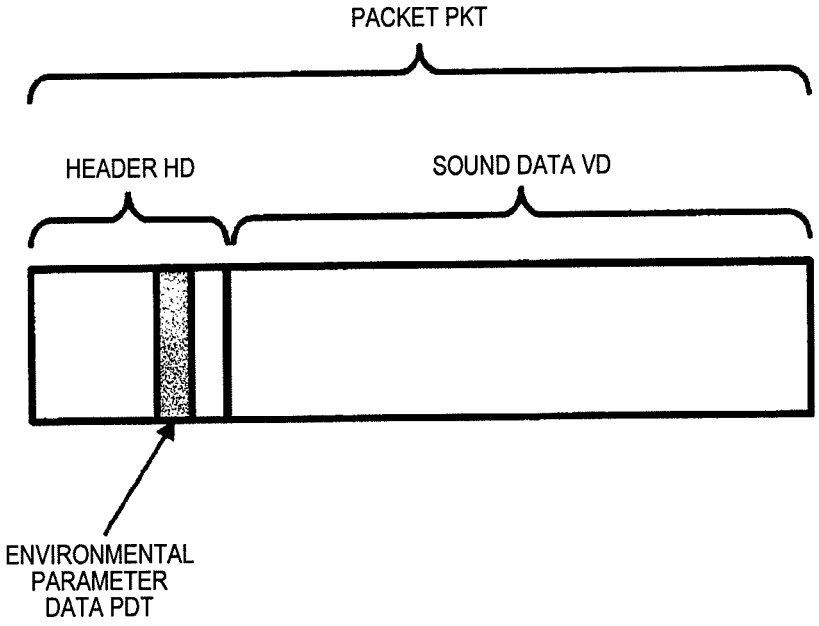
FIG. 6A is a diagram illustrating a first example of the structure of a packet transmitted from an omnidirectional microphone array device.

Transmitter 291 generates packet PKT including sound data VD encoded by controller 281 in response to an instruction from controller 281, and transmits the generated packet to directivity control device 3 and recorder device 4. FIG. 6A is a diagram illustrating a first example of a structure of packet PKT transmitted from omnidirectional microphone array device 2. Transmitter 291 stores encoded environmental parameter data PDT, for example, in a storage region of header HD, and generates packet PKT in which encoded sound data VD is stored in a storage region of a payload. Meanwhile, a storage region of header HD may include a time stamp indicating information related to a measurement date and time and a measurement time which are measured by temperature detector TS, humidity detector HS, and atmospheric pressure detector AS, and may include recognition information inherent to the microphone element. The same is true of the following exemplary embodiments.

Temperature detector TS as an example of an environmental parameter obtainer is configured using, for example, a known temperature sensor. The temperature detector periodically detects (measures) the surrounding temperature during the sound collection performed by omnidirectional microphone array device 2, and outputs the measured value of the temperature to controller 281.

Humidity detector HS as an example of an environmental parameter obtainer is configured using, for example, a known humidity sensor. The humidity detector periodically detects (measures) ambient humidity (for example, water vapor pressure) during the sound collection of omnidirectional microphone array device 2, and outputs the measured value of the humidity to controller 281.

Atmospheric pressure detector AS as an example of an environmental parameter obtainer is configured using, for example, a known atmospheric pressure sensor. The atmospheric pressure detector periodically detects (measures) ambient atmospheric pressure during the sound collection of omnidirectional microphone array device 2, and outputs the measured value of the atmospheric pressure to controller 281.

Figure 5A:
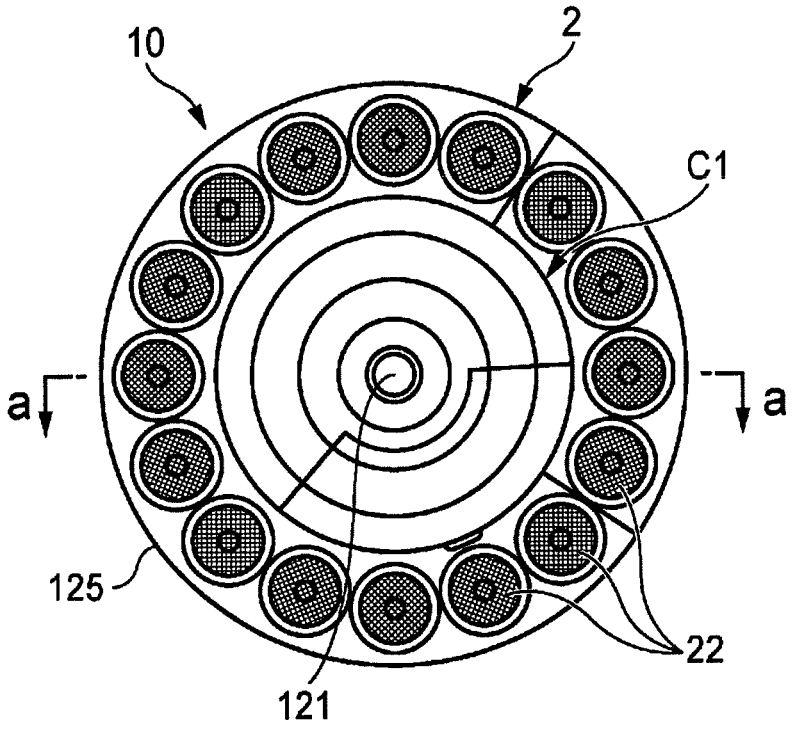
FIG. 5A is a plan view illustrating a state where a camera device is fitted into a disk-like microphone housing of an omnidirectional microphone array device, when seen from below in a vertical direction.
Figure 5B:
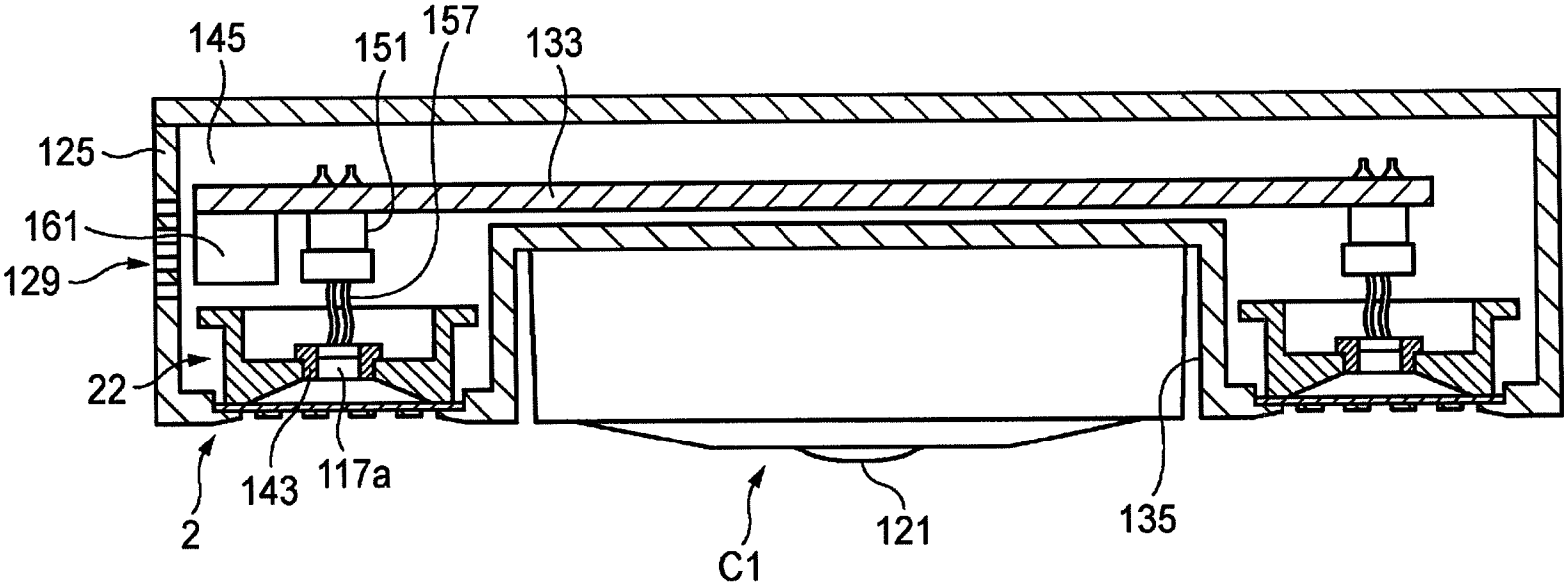
FIG. 5B is a cross-sectional view illustrating a first example of a cross-section a-a of FIG. 5A.

FIG. 5A is a plan view illustrating a state where camera device C1 is fitted into plate-like microphone housing 125 of omnidirectional microphone array device 2, when seen from the below in a vertical direction. FIG. 5B is a cross-sectional view illustrating a first example of cross-section a-a of FIG. 5A. Camera device C1 includes a disk-like housing formed to have, for example, a disk shape. In camera device C1, fish-eye lens 121 for condensing omnidirectional incident light onto an imaging element is provided so as to protrude from a recessed position of a central portion of the disk-like housing.

In directivity control system 10 according to the present exemplary embodiment, omnidirectional microphone array device 2 includes concentric plate-like microphone housing 125 in which a disk-like housing of camera device C11 is fitted into central concave portion 135. A plurality of (for example, sixteen) microphone units 22 are concentrically disposed within plate-like microphone housing 125. For example, electret condenser microphone (ECM) 117*a* having high sound quality and a small size is used as microphone unit 22, and the same is true of the following exemplary embodiments. Microphone unit 22 has rubber bushing 143 inserted thereinto, and electret condenser microphone (ECM) 117*a* having high sound quality and a small size is fixed to the rubber bushing.

An upper surface (for example, a surface to which microphone unit 22 is attached) of plate-like microphone housing 125 of omnidirectional microphone array device 2 and an upper surface (for example, a surface of fish-eye lens 121) of the disk-like housing of camera device C11 have a positional relationship having no step therebetween (for example, have a horizontal surface or a continuous curved surface close to a horizontal surface) so that a factor due to the deterioration in sound characteristics such as the reflection of a sound does not occur, and the same is true of the following exemplary embodiments.

In plate-like microphone housing 125, circular or quadrilateral microphone substrate 133 having a diameter equal to or larger than the diameter of camera device C11 can be disposed in space 145 within the housing which is formed above camera device C11. In plate-like microphone housing 125, an AD converter may be disposed in the vicinity of connector 151 or may be disposed in the central portion of microphone substrate 133. In plate-like microphone housing 125, since a large area for microphone substrate 133 can be secured, the microphone substrate can be disposed in proximity to microphone unit 22, and thus it is possible to shorten microphone cable 155, which leads to an improvement in noise resistance interference characteristics (EMS).

Vent hole 129 is formed in the lateral side portion of plate-like microphone housing 125, and temperature humidity atmospheric pressure measurement element 161 including temperature detector TS, humidity detector HS, and atmospheric pressure detector AS, which are described above, is disposed in the vicinity of vent hole 129 and in the lateral side portion of plate-like microphone housing 125. In other words, temperature humidity atmospheric pressure measurement element 161 is disposed in the vicinity of vent hole 129 and at the end (that is, on the lateral side portion side of plate-like microphone housing 125) of microphone substrate 133. On the other hand, when a vent hole is formed in the upper surface (specifically, on the mounting surface side of electret condenser microphone (ECM) 117*a* having a high sound quality and a small size) of plate-like microphone housing 125, some sound waves are incident on the vent hole, and sound characteristics of collected sound waves deteriorate. Accordingly, it is preferable that vent hole 129 is formed in the lateral side portion of plate-like microphone housing 125.

Thereby, the inside (space 145 in the housing) of plate-like microphone housing 125 and the outside (for example, the outside air) do not differ from each other in measured values of temperature, humidity, and atmospheric pressure, and thus omnidirectional microphone array device 2 can suppress the influence of heat generation of electronic components (for example, a CPU and an A/D converter) which are disposed inside plate-like microphone housing 125 and can acquire measured values of appropriate temperature, humidity, and atmospheric pressure. As described later, omnidirectional microphone array device 2 or directivity control device 3 can calculate an accurate sound velocity using measured values of appropriate temperature, humidity, and atmospheric pressure.

Figure 6B:
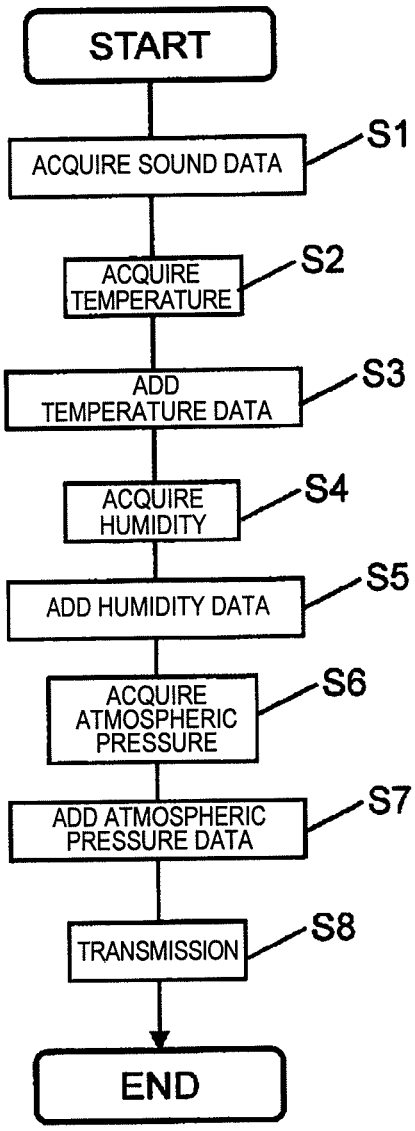
FIG. 6B is a flow chart illustrating a first example of an operation procedure of an omnidirectional microphone array device.

FIG. 6B is a flow chart illustrating a first example of an operation procedure of omnidirectional microphone array device 2. In FIG. 6B, controller 281 acquires pieces of digital sound data obtained by converting pieces of sound data of sounds, collected by respective microphone elements 221, 222, . . . , and 22*n*, using respective A/D converters 241, 242, . . . , and 24*n* (S1). Controller 281 acquires a measured value of the ambient temperature of omnidirectional microphone array device 2 which is detected by temperature detector TS (S2). Controller 281 outputs temperature data indicating the measured value of the temperature acquired in step S2 to transmitter 291 and gives an instruction for the adding of the temperature data to packet PKT (S3).

Controller 281 acquires a measured value of ambient humidity of omnidirectional microphone array device 2 which is detected by humidity detector HS (S4). Controller 281 outputs humidity data indicating the measured value of the humidity acquired in step S4 to transmitter 291 and gives an instruction for the adding of the humidity data to packet PKT (S5).

Controller 281 acquires a measured value of ambient atmospheric pressure of omnidirectional microphone array device 2 which is detected by atmospheric pressure detector AS (S6). Controller 281 outputs atmospheric pressure data indicating the measured value of the atmospheric pressure acquired in step S6 to transmitter 291 and gives an instruction for the adding of the atmospheric pressure data to packet PKT (S7). Transmitter 291 generates packet PKT illustrated in FIG. 6A using various pieces of data (specifically, sound data, temperature data, humidity data, and atmospheric pressure data) which are acquired from controller 281 and transmits the generated packet to directivity control device 3 and recorder device 4 (S8).

Figure 7A:
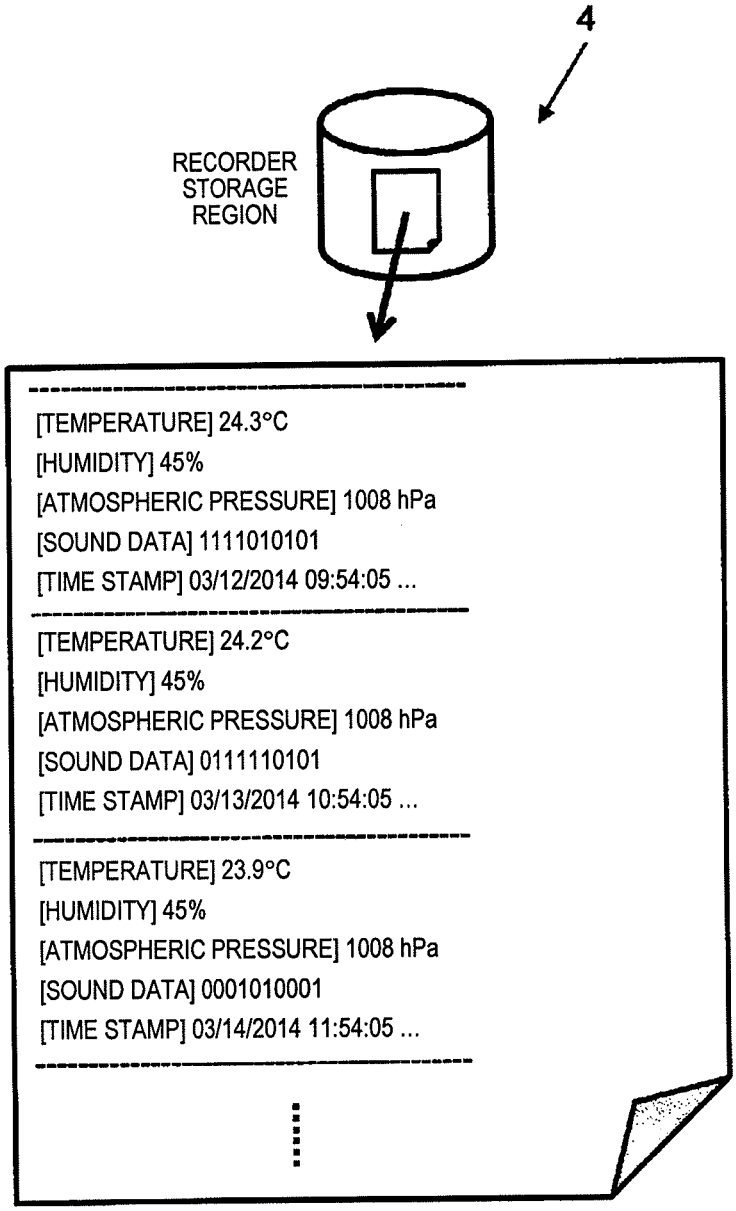
FIG. 7A is a diagram illustrating a first example of data stored in a recorder storage region of a recorder device.

FIG. 7A is a diagram illustrating a first example of data stored in a recorder storage region of recorder device 4. As illustrated in FIG. 7A, temperature data, humidity data, atmospheric pressure data, sound data, and a time stamp are stored in the recorder storage region of recorder device 4 in association with each other for each record. The time stamp is information indicating a timing at which detection (measurement) is performed by each of temperature detector TS, humidity detector HS, and atmospheric pressure detector AS.

First Example of Calculation of Sound Velocity Vs

Figure 7B:
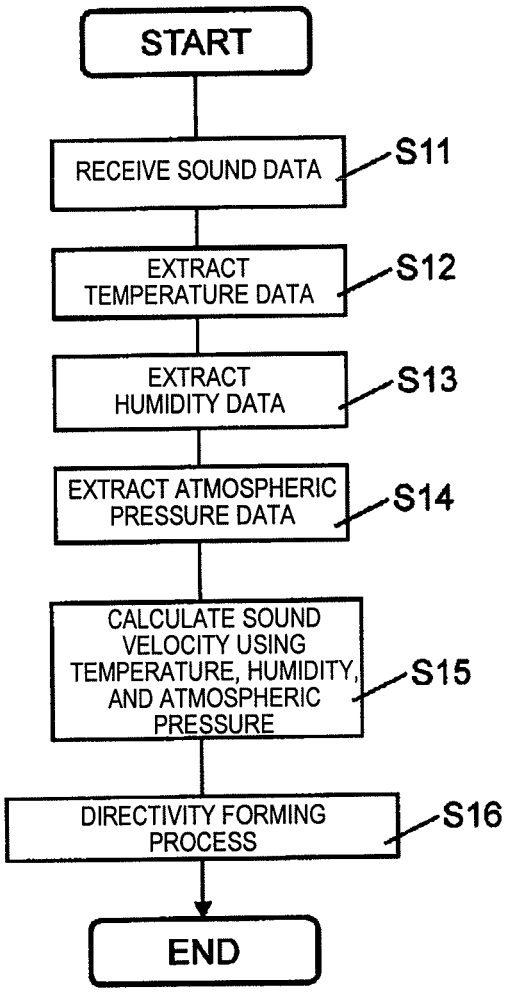
FIG. 7B is a flow chart illustrating a first example of an operation procedure of a directivity control device.

FIG. 7B is a flow chart illustrating a first example of an operation procedure of directivity control device 3. In FIG. 7B, a process for directivity control device 3 to calculate sound velocity Vs using temperature data, humidity data, and atmospheric pressure data which are stored in directivity control device 3 or recorder device 4 and a process of performing the application of a delay time (see FIG. 3) using calculated sound velocity Vs to thereby form directivity will be described.

In FIG. 7B, communicator 31 receives packet PKT (that is, sound data, temperature data, humidity data, and atmospheric pressure data) which is transmitted from omnidirectional microphone array device 2 and outputs the received packet to signal processor 33 (S11). In step S11, sound velocity corrector 34*b* extracts the temperature data, the humidity data, and the atmospheric pressure data from packet PKT received by communicator 31 (S12, S13, S14). Sound velocity corrector 34*b* calculates sound velocity Vs necessary for the formation of the directivity of sound data using the temperature data, the humidity data, and the atmospheric pressure data (S15).

Here, the calculation of sound velocity Vs using temperature data, humidity data, and atmospheric pressure data in sound velocity corrector 34*b* will be specifically described. Sound velocity V [m/s] in dry air is expressed as Expression (2) based on temperature T [° C.]. Meanwhile, an approximate expression of Expression (2) is known to be expressed as Expression (3).

$$V=20.055\sqrt{273.15+T} \tag{2}$$

$$V=331.5+0.6T \tag{3}$$

A relationship between sound velocity V in dry air and sound velocity Vs in the air including water vapor having water vapor pressure P [Pa] is expressed as Expression (4). In Expression (4), $\gamma_w$ denotes a ratio of specific heat at constant pressure of water vapor to specific heat at constant volume thereof and has a value of approximately 1.33, $\gamma_a$ denotes a ratio of specific heat at constant pressure of dry air to specific heat at constant volume thereof and has a value of approximately 1.40, and H denotes atmospheric pressure [Pa].

$$V = Vs \times \sqrt{1 - \frac{P}{H}\left(\frac{\gamma_w}{\gamma_a} - 0.622\right)} \tag{4}$$

Humidity measured by a general humidity sensor is relative humidity RH (that is, a ratio of water vapor pressure P to saturated water vapor pressure $P_0$ in temperature during measurement (partial pressure)), and a relationship between relative humidity RH and water vapor pressure P is expressed as Expression (5). In Expression (5), in order to calculate water vapor pressure P, it is necessary to know saturated water vapor pressure $P_0$. Saturated water vapor pressure $P_0$ changes depending on temperature T, and is expressed as Expression (6). Expression (6) is called Teten's formula. For example, Wagner's formula may be used as an expression for obtaining saturated water vapor pressure $P_0$.

$$P = P_0 \times RH \div 100 \tag{5}$$

$$P_0 = 6.1078 \times 10^{(7.5T/T+237.3)} \times 100 \tag{6}$$

Accordingly, sound velocity in the air changes depending on at least temperature, and also changes depending on water vapor pressure in the air. The degree of influence of the change in sound velocity depending on water vapor pressure also changes depending on atmospheric pressure as expressed as Expression (4). As described later, since a sound velocity also changes depending on wind, more accurate directivity is required to be formed, for example, when omnidirectional microphone array device 2 is installed outdoors. Accordingly, it is preferable that sound velocity Vs is calculated in view of wind direction and wind velocity (to be described later). Meanwhile, factors affecting the change in sound velocity Vs have an order of temperature, water vapor pressure (in other words, humidity), and atmospheric pressure. Atmospheric pressure (barometic pressure) affects sound velocity Vs only when water vapor pressure is not 0.

As described above, sound velocity corrector 34*b* calculates sound velocity V as sound velocity Vs according to Expression (2) when only temperature data among temperature data, humidity data, and atmospheric pressure data is used, and calculates sound velocity Vs according to Expression (4) when temperature data, humidity data, and atmospheric pressure data are used.

Meanwhile, although not shown in FIG. 7B, directing direction calculator 34*a* calculates coordinates ($\theta_{MAh}$, $\theta_{MAv}$) indicating the directing direction toward a sound position corresponding to a designated position designated by a user's operation and outputs the calculated coordinates to output controller 34*c*, after step S15 is performed. Output controller 34*c* forms directivity in the directing direction with respect to the sound data received in step S11, using sound velocity Vs calculated in step S15 and the coordinates ($\theta_{MAh}$, $\theta_{MAv}$) indicating the directing direction which are output from directing direction calculator 34*a* (S16).

As described above, in directivity control system 10 according to the present exemplary embodiment, directivity control device 3 as an example of a sound velocity correction device according to the disclosure acquires surrounding environmental parameters (for example, temperature, humidity, and atmospheric pressure) during the collection of a sound emitted from a sound source (for example, person HM illustrated in FIG. 13A) in a specific directing direction when seen from omnidirectional microphone array device 2. Thus, it is possible to calculate accurate sound velocity Vs using measured values of surrounding environmental parameters during the sound collection, and to suppress deterioration in directivity formation accuracy in the directing direction toward the sound source from omnidirectional microphone array device 2.

Second Example of Calculation of Sound Velocity Vs

Figure 8A:
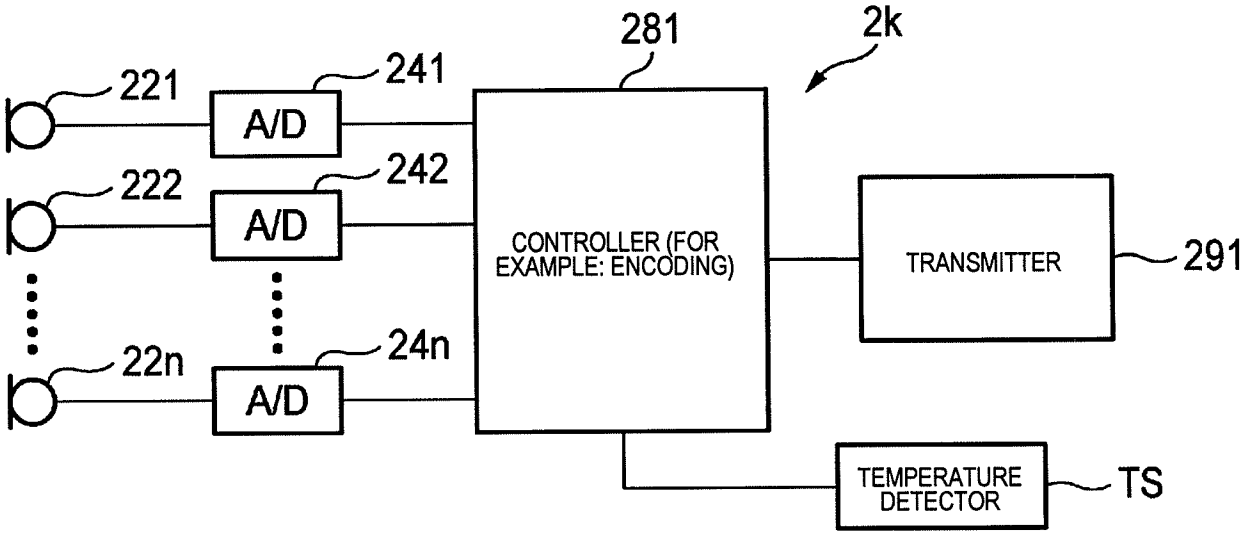
FIG. 8A is a block diagram illustrating a second example of an internal configuration of an omnidirectional microphone array device.

In the present exemplary embodiment, omnidirectional microphone array device 2 may detect at least temperature and may transmit the detected temperature to directivity control device 3 (see FIG. 8A). Further, plate-like microphone housing 125 of omnidirectional microphone array device 2 is provided with vent hole 129, but may not be provided with vent hole 129 (see FIG. 8B).

Figure 8B:
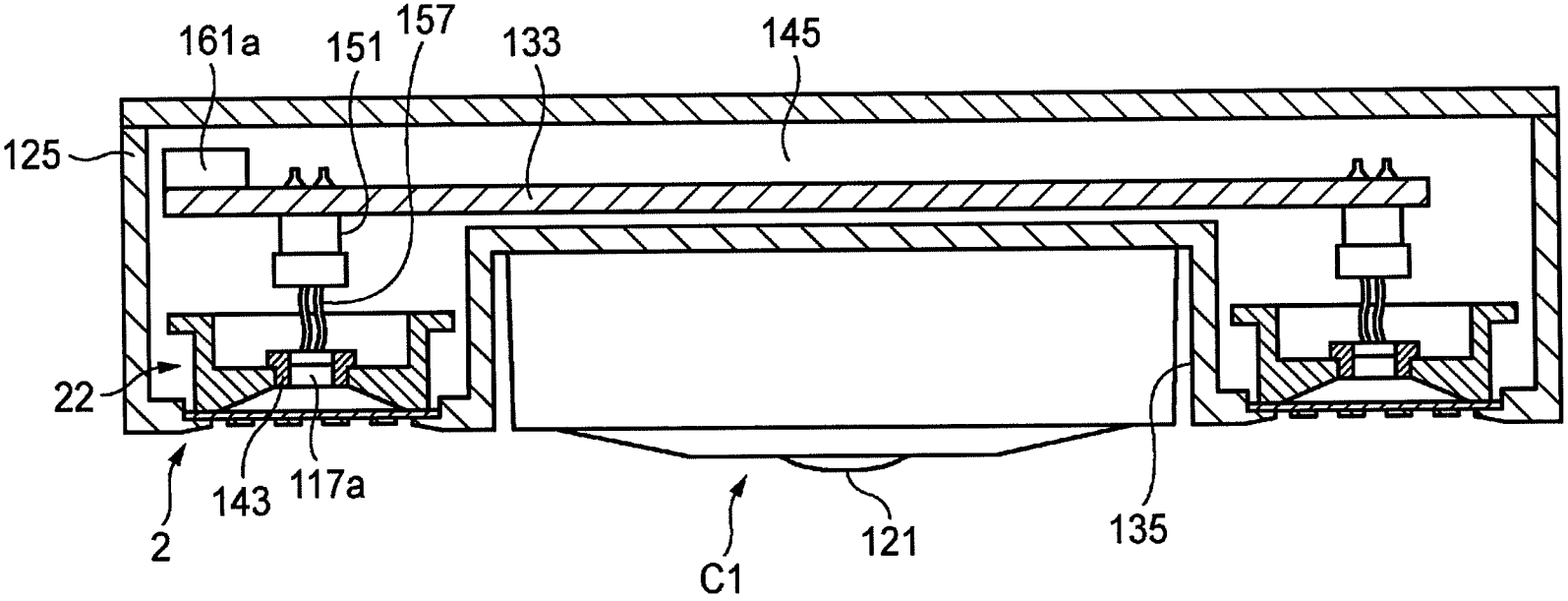
FIG. 8B is a cross-sectional view illustrating a second example along the cross-section a-a of FIG. 5A.

FIG. 8A is a block diagram illustrating a second example of an internal configuration of omnidirectional microphone array device 2*k*. FIG. 8B is a cross-sectional view illustrating a second example along cross-section a-a of FIG. 5A. In the description of FIG. 8A, the same components as in the units of omnidirectional microphone array device 2 illustrated in FIG. 4 are denoted by the same reference numerals and signs, a description thereof will be simplified or omitted, and contents that are different will be described. In FIG. 8A, humidity detector HS and atmospheric pressure detector AS are omitted. In other words, in FIG. 8A, only temperature detector TS which is a factor most affecting a change in sound velocity Vs is provided in omnidirectional microphone array device 2.

In FIG. 8B, temperature measurement element 161*a* equivalent to temperature detector TS is disposed on the lateral side portion side of plate-like microphone housing 125 and at an end on microphone substrate 133, unlike in FIG. 5B. When temperature is set to be in a balanced state, there is known a property that a difference between the internal temperature of plate-like microphone housing 125 and the external temperature thereof becomes substantially constant. Consequently, controller 281 performs correction so as to add or subtract a predetermined amount (for example, +2 [° C.]) to or from a measured value of the temperature detected through temperature detector TS, using the property, and then performs encoding thereon. This is the same as in both FIG. 5B and FIG. 8B, and it is preferable that temperature humidity atmospheric pressure measurement element 161 and temperature measurement element 161*a* are disposed at a position (for example, on the end side of microphone substrate 133) which is separated from a position at which heat generation components (for example, a CPU and an A/D converter) are disposed (mounted).

On the other hand, initial setting values may be used as values of humidity and atmospheric pressure, as factors of changes in sound velocity Vs, which have a lower degree of influence than temperature. For example, during the initial setting of directivity control system 10, average values of humidity and atmospheric pressure are measured in advance, and values of humidity and atmospheric pressure input from operator 32 by a user's operation are stored in memory 38. Sound velocity corrector 34*b* uses initial setting values of humidity and atmospheric pressure from memory 38 during the calculation of sound velocity Vs. Meanwhile, the values of humidity and atmospheric pressure are not limited to those during initial setting, and may be appropriately changed to values input from operator 32 by a user's operation and may be stored in memory 38.

Figure 9A:
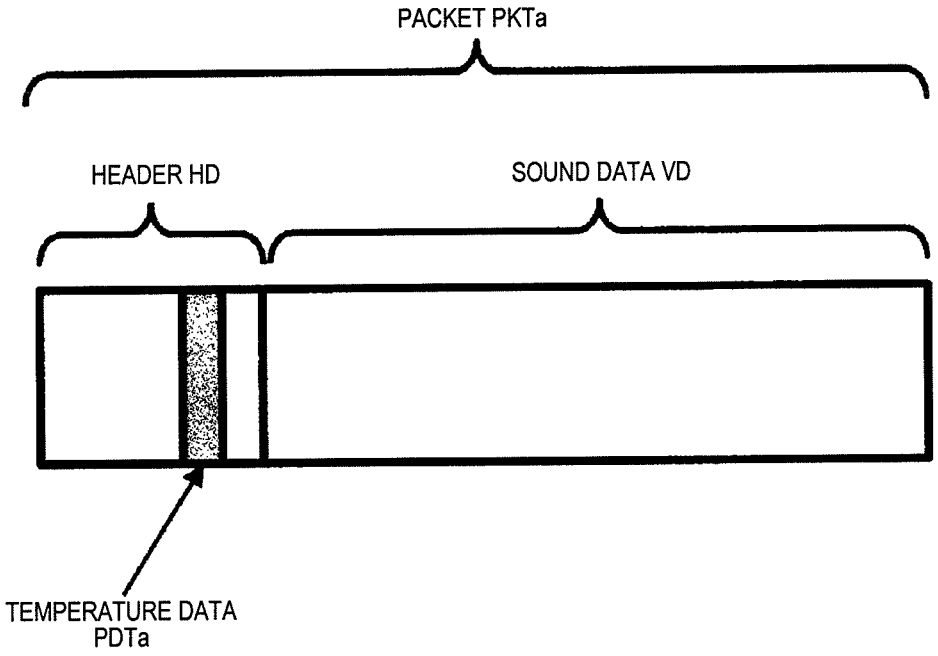
FIG. 9A is a diagram illustrating a second example of the structure of a packet transmitted from an omnidirectional microphone array device.

FIG. 9A is a diagram illustrating a second example of the structure of packet PKT transmitted from omnidirectional microphone array device 2*k*. Transmitter 291 stores encoded temperature data PDTa, for example, in a storage region of header HD and generates packet PKTa in which encoded sound data VD is stored in a storage region of a payload.

Figure 9B:
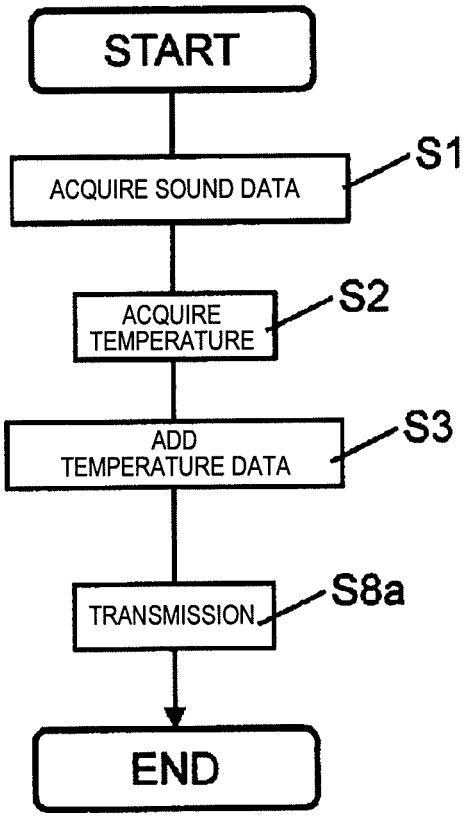
FIG. 9B is a flow chart illustrating a second example of an operation procedure of an omnidirectional microphone array device.

FIG. 9B is a flow chart illustrating a second example of an operation procedure of omnidirectional microphone array device 2*k*. In the description of FIG. 9B, the same operations as the operations in FIG. 6B are denoted by the same step numbers, a description thereof will be simplified or omitted, and different contents will be described. In FIG. 9B, the processes of step S4 to step S7 illustrated in FIG. 6B are omitted. Specifically, after step S3 is performed, transmitter 291 generates packet PKTa illustrated in FIG. 9A using various pieces of data (specifically, sound data and temperature data) which are acquired from controller 281 and transmits the generated packet to directivity control device 3 and recorder device 4 (S8*a*).

Figure 10A:
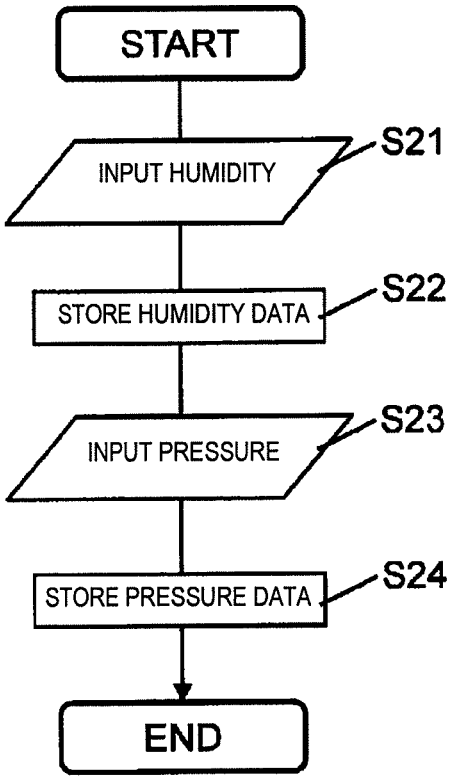
FIG. 10A is a flow chart illustrating an example of an operation procedure of initial setting for setting data of an environmental parameter in a directivity control device.
Figure 10B:
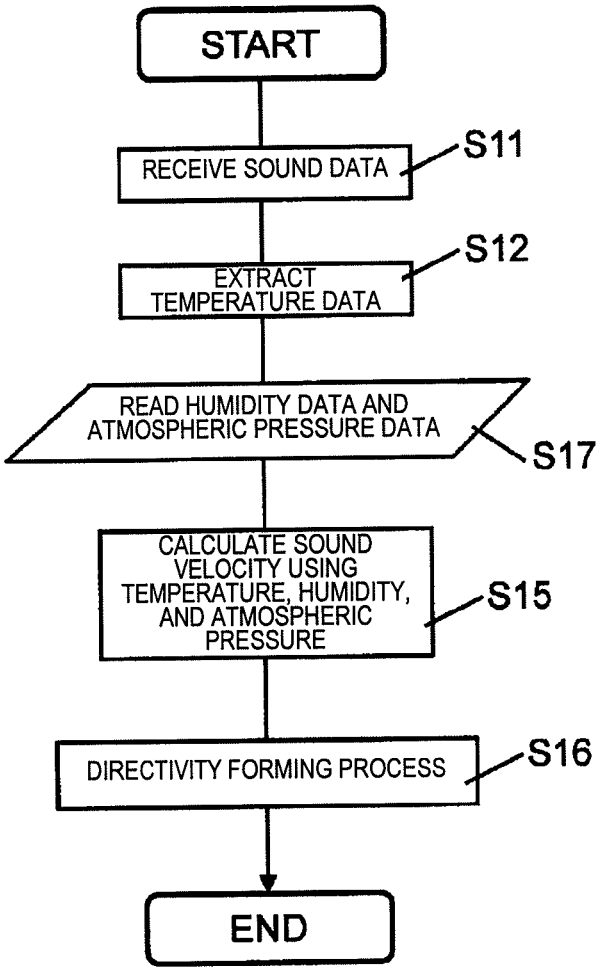
FIG. 10B is a flow chart illustrating a second example of an operation procedure of a directivity control device.
Figure 10C:
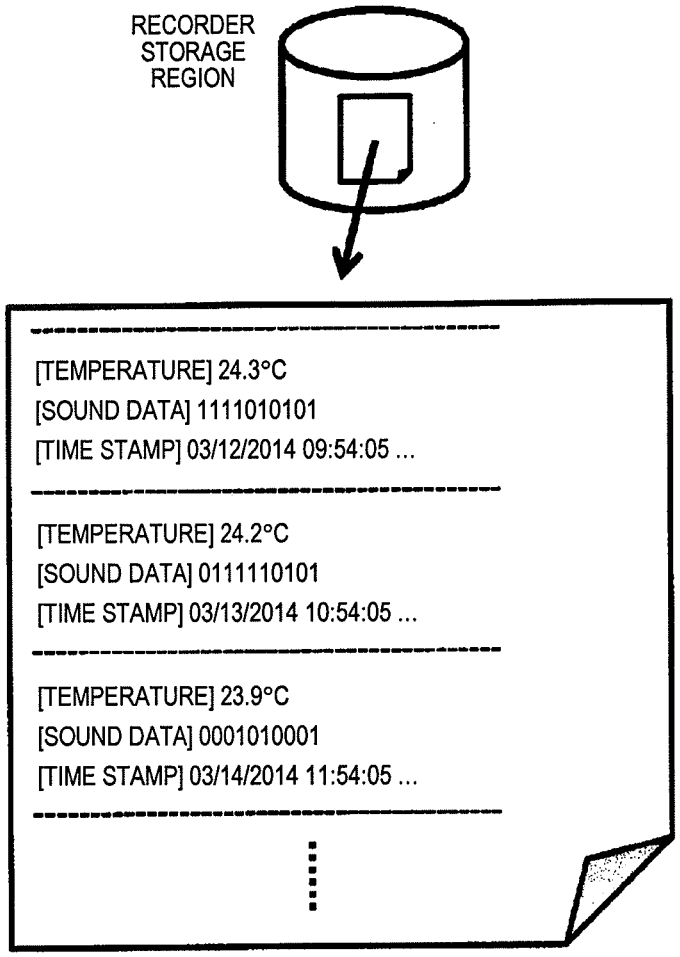
FIG. 10C is a diagram illustrating a second example of data stored in a recorder storage region of a recorder device.

FIG. 10A is a flow chart illustrating an example of an operation procedure of initial setting for setting data of an environmental parameter in directivity control device 3. FIG. 10B is a flow chart illustrating a second example of an operation procedure of directivity control device 3. FIG. 10C is a diagram illustrating a second example of data stored in a recorder storage region of recorder device 4.

In FIG. 10A, when humidity data (for example, an initial setting value of humidity which is measured in advance) is input from operator 32 by a user's operation (S21), signal processor 33 stores (saves) the humidity data input in step S21 in memory 38 (S22). When atmospheric pressure data (for example, an initial setting value of atmospheric pressure which is measured in advance) is input from operator 32 by a user's operation (S23), signal processor 33 stores (saves) the atmospheric pressure data input in step S23 in memory 38 (S24).

In the description of FIG. 10B, the same operations as the operations in FIG. 7B are denoted by the same step numbers, a description thereof will be simplified or omitted, and different contents will be described. In FIG. 10B, after step S12 is performed, sound velocity corrector 34*b* reads out humidity data and atmospheric pressure data (for example, the data saved in step S22 and step S24 illustrated in FIG. 10A) from memory 38 (S17), and sound velocity Vs necessary for the formation of the directivity of sound data is calculated according to Expression (4) mentioned above (S15). The operation subsequent to step S15 is the same as step S16 of FIG. 7B, and thus a description thereof will be omitted here.

As illustrated in FIG. 10C, in a recorder storage region of recorder device 4, measured values of environmental parameters transmitted from omnidirectional microphone array device 2 are temperature data and a time stamp. Accordingly, temperature data, sound data, and a time stamp are stored in association with each other for each record. Meanwhile, values written in a program code of sound velocity corrector 34*b* in advance as constants may be used as humidity data and atmospheric pressure data, while the humidity data and the atmospheric pressure data are not input in the operation procedure of the initial setting illustrated in FIG. 10A.

As described above, in the second example of the calculation of sound velocity Vs, only temperature measurement element 161*a* corresponding to temperature detector TS is disposed in the lateral side portion of plate-like microphone housing 125. Directivity control device 3 as an example of a sound velocity correction device according to the disclosure can suppress the influence due to heat generation of electronic components (for example, a CPU and an A/D converter) which are disposed inside plate-like microphone housing 125. When temperature inside plate-like microphone housing 125 is set to be in a balanced state, it is possible to calculate accurate sound velocity by correcting measured temperature data by a predetermined amount (for example, +2 [° C.]) based on a difference value between the internal temperature of plate-like microphone housing 125 and the external temperature thereof, using a property that the above-mentioned difference value becomes substantially constant.

Third Example of Calculation of Sound Velocity Vs

Figure 11A:
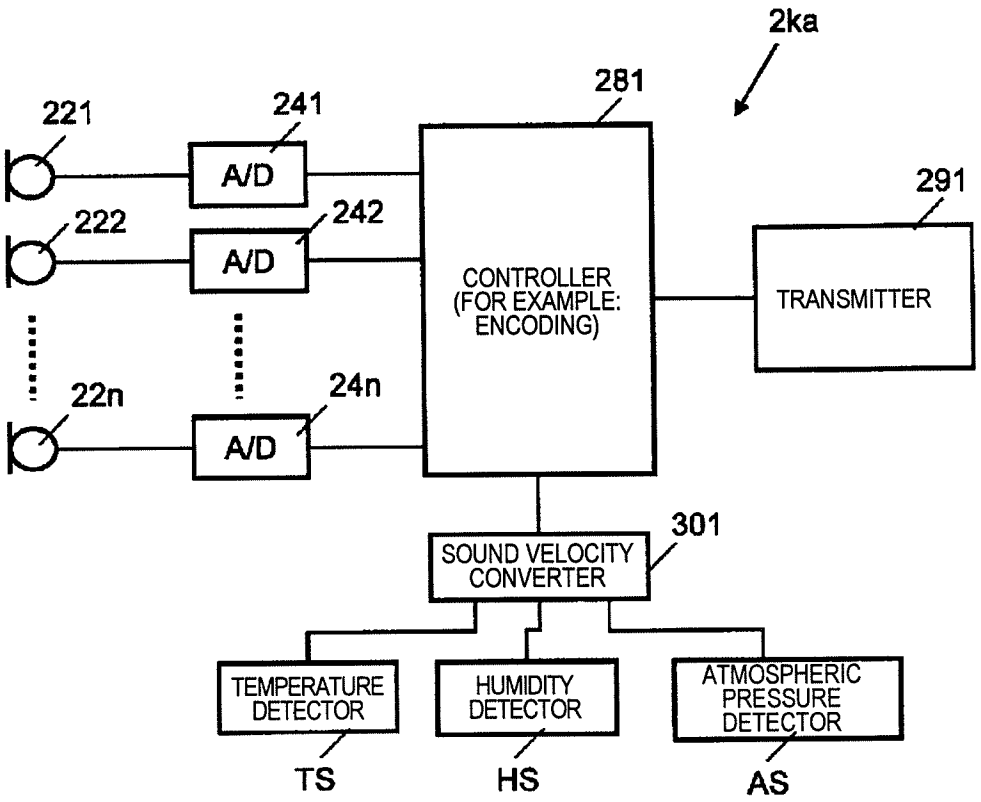
FIG. 11A is a block diagram illustrating a third example of an internal configuration of an omnidirectional microphone array device.

In the present exemplary embodiment, omnidirectional microphone array device 2 may calculate sound velocity Vs (see FIG. 11A). Omnidirectional microphone array device 2 transmits sound velocity Vs calculated by omnidirectional microphone array device 2, or a difference value between sound velocity Vs obtained by calculation and a predetermined reference value (for example, 340 [m/s]) to directivity control device 3 and recorder device 4 (see FIGS. 11B and 11C).

Figure 11B:
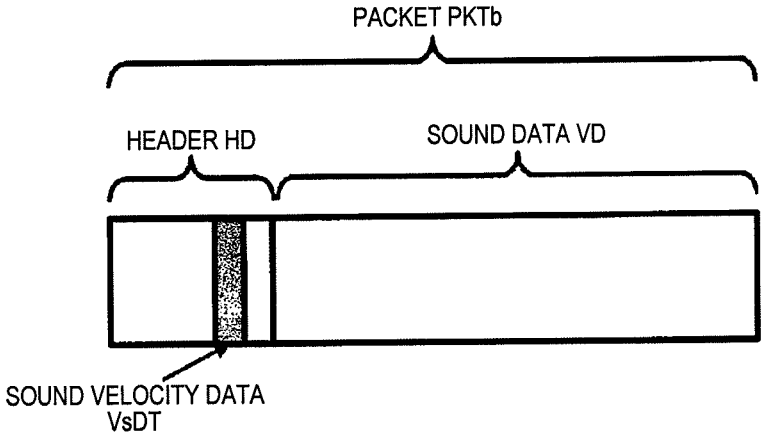
FIG. 11B is a diagram illustrating a third example of the structure of a packet transmitted from an omnidirectional microphone array device.
Figure 11C:
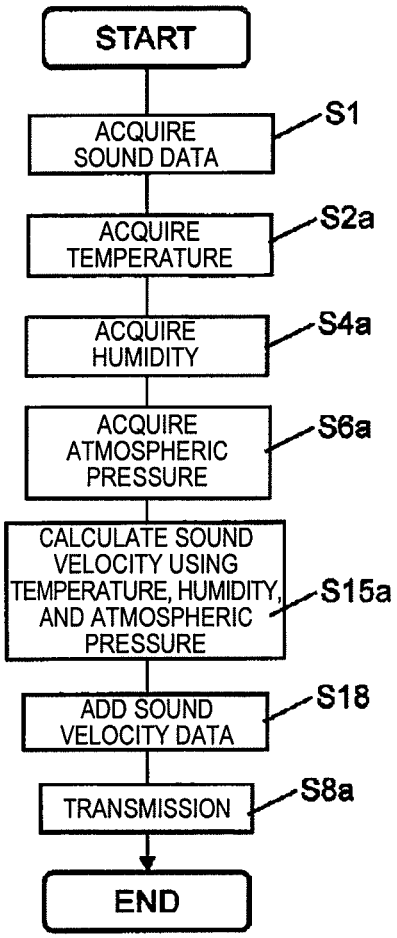
FIG. 11C is a flow chart illustrating a third example of an operation procedure of an omnidirectional microphone array device.

FIG. 11A is a block diagram illustrating a third example of an internal configuration of omnidirectional microphone array device 2*ka*. FIG. 11B is a diagram illustrating a third example of the structure of packet PKTb transmitted from omnidirectional microphone array device 2*ka*. FIG. 11C is a flow chart illustrating a third example of an operation procedure of omnidirectional microphone array device 2*ka*. In the description of FIG. 11A, the same components as the units of omnidirectional microphone array device 2 illustrated in FIG. 4 are denoted by the same reference numerals and signs, a description thereof will be simplified or omitted, and different contents will be described. In FIG. 11A, sound velocity converter 301 is further added to omnidirectional microphone array device 2 illustrated in FIG. 4.

Sound velocity converter 301 calculates sound velocity Vs necessary for the formation of the directivity of sound data in accordance with Expression (4) to Expression (6) mentioned above, using outputs (that is, temperature data, humidity data, and atmospheric pressure data) of temperature detector TS, humidity detector HS, and atmospheric pressure detector AS and outputs the calculated sound velocity to controller 281. Controller 281 performs encoding of an input digital sound signal and data of sound velocity Vs output from sound velocity converter 301 and outputs the encoded signal and data to transmitter 291.

Transmitter 291 stores encoded sound velocity data VsDT, for example, in a storage region of header HD and generates packet PKTb that stores encoded sound data VD in a storage region of a payload (see FIG. 11B).

In the description of FIG. 11C, the same operations as the operations in FIG. 6B are denoted by the same step numbers, a description thereof will be simplified or omitted, and different contents will be described. In FIG. 11C, after step S1 is performed, sound velocity converter 301 acquires a measured value of the ambient temperature of omnidirectional microphone array device 2 which is detected by temperature detector TS, a measured value of the ambient humidity of omnidirectional microphone array device 2 which is detected by humidity detector HS, and a measured value of the ambient atmospheric pressure of omnidirectional microphone array device 2 which is detected by atmospheric pressure detector AS (S2*a*, S4*a*, and S6*a*).

Sound velocity converter 301 calculates sound velocity Vs necessary for the formation of the directivity of sound data in accordance with Expression (4) to Expression (6) mentioned above, using the temperature data, the humidity data, and the atmospheric pressure data which are acquired in step S2*a*, step S4*a*, and step S6*a*, and outputs the calculated sound velocity to controller 281 (S15*a*). Controller 281 outputs data of sound velocity Vs calculated by sound velocity converter 301 to transmitter 291 and gives an instruction for the adding of the sound velocity data to packet PKT (S18). Transmitter 291 generates packet PKTb illustrated in FIG. 11B using various pieces of data (specifically, sound data and sound velocity data) which are acquired from controller 281 and transmits the generated packet to directivity control device 3 and recorder device 4 (S8*a*).

Meanwhile, omnidirectional microphone array device 2*ka* may transmit the calculated value of sound velocity Vs, which is included in packet PKTb, to directivity control device 3 and recorder device 4, and may transmit a difference value between the calculated value of sound velocity Vs and a predetermined reference value, which is included in packet PKTb, to directivity control device 3 and recorder device 4. In this case, directivity control device 3 calculates sound velocity Vs using the predetermined reference value and the difference value.

As described above, in the third example of the calculation of sound velocity Vs, omnidirectional microphone array device 2*ka* as an example of a sound velocity correction device according to the disclosure can calculate sound velocity Vs using measured values of environmental parameters (for example, temperature, humidity, and atmospheric pressure). Since a difference value between a calculated value of sound velocity Vs or a difference value between the calculated value of sound velocity Vs and a predetermined reference value (for example, 340 [m/s]) of a sound velocity is transmitted to directivity control device 3 and recorder device 4, directivity control device 3 corrects sound velocity Vs using the difference value between sound velocity Vs, calculated using the measured values of the environmental parameters, and the predetermined reference value. Thus, it is possible to easily correct a sound velocity by acquiring a difference value between a sound velocity value, calculated using the measured values of the environmental parameters, and a predetermined reference value. When omnidirectional microphone array device 2*ka* transmits a difference value between a calculated value of sound velocity Vs and a predetermined reference value (for example, 340 [m/s]) of a sound velocity, it is possible to reduce the amount of data to be transmitted. Therefore, it is possible to shorten the amount of time required to acquire data necessary for the correction of a sound velocity in directivity control device 3.

Fourth Example of Calculation of Sound Velocity Vs

Figure 12A:
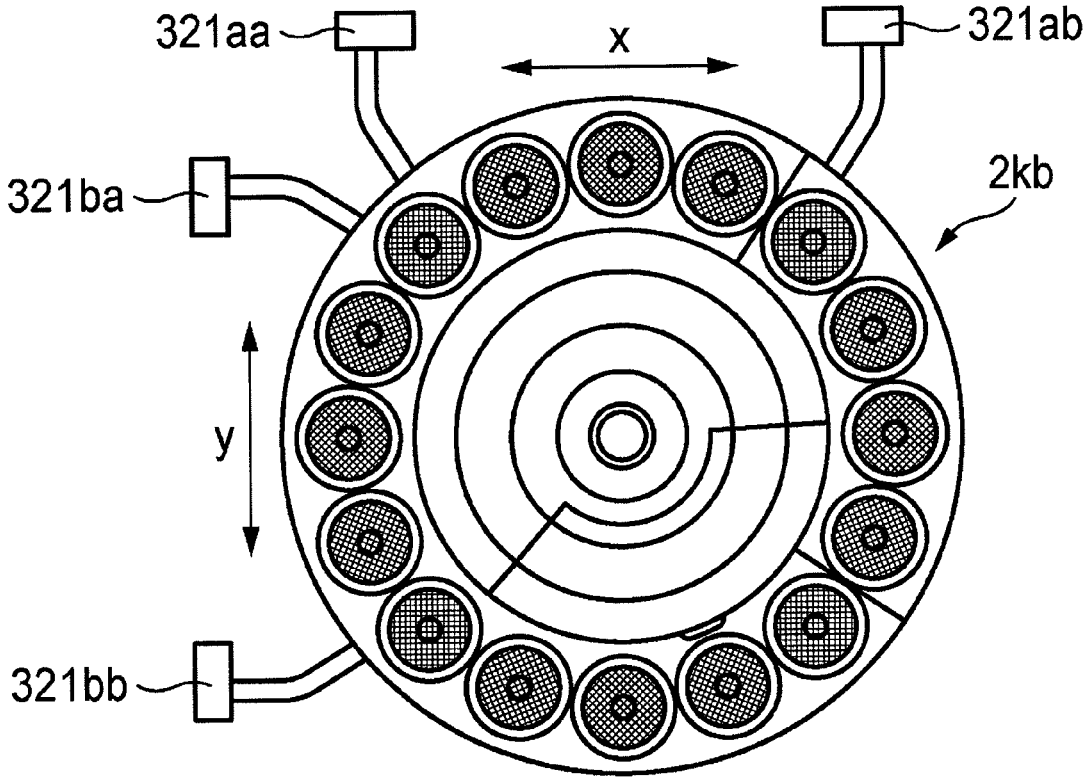
FIG. 12A is a plan view illustrating a state where a camera device is fitted into a disk-like microphone housing of an omnidirectional microphone array device having x-direction anemometers and y-direction anemometers attached thereto, when seen from below in a vertical direction.
Figure 12B:
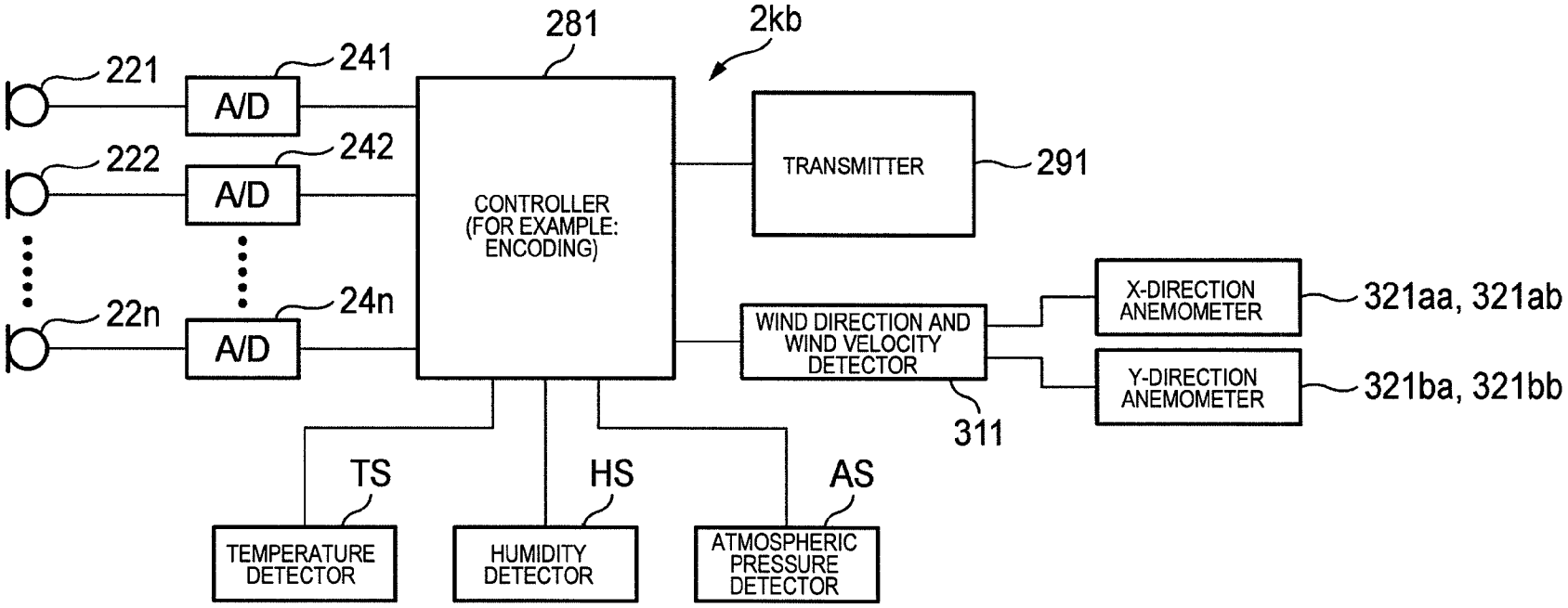
FIG. 12B is a block diagram illustrating a fourth example of an internal configuration of an omnidirectional microphone array device.

In the present exemplary embodiment, as described above, sound velocity Vs may be calculated in view of wind direction and wind velocity in addition to temperature, humidity, and atmospheric pressure as environmental parameters (see FIGS. 12A and 12B). FIG. 12A is a plan view illustrating a state where camera device C11 is fitted into plate-like microphone housing 125 of omnidirectional microphone array device 2*kb* having x-direction anemometers 321*aa* and 321*ab* and y-direction anemometers 321*ba* and 321*bb* attached thereto, when seen from the below in a vertical direction. FIG. 12B is a block diagram illustrating a fourth example of an internal configuration of omnidirectional microphone array device 2*kb*.

In the description of FIG. 12A, contents different from the description of FIG. 5A will be described, and a description of identical contents will be omitted. Further, in the description of FIG. 12B, the same components as those in the description of FIG. 4 are denoted by the same reference numerals and signs, a description thereof will be simplified or omitted, and different contents will be described. Specifically, omnidirectional microphone array device 2*kb* is further provided with pair of x-direction anemometers 321*aa* and 321*ab* and pair of y-direction anemometers 321*ba* and 321*bb* which are capable of detecting wind direction and wind velocity in two axes (x-direction, y-direction) orthogonal to each other, unlike omnidirectional microphone array device 2 illustrated in FIG. 4.

One x-direction anemometer 321*aa* (or 321*ab*) transmits ultrasonic waves to the other x-direction anemometer 321*ab* (or 321*aa*) disposed in parallel in an x-direction. The other x-direction anemometer 321*ab* (or 321*aa*) receives the ultrasonic waves transmitted from one x-direction anemometer 321*aa* (or 321*ab*).

One y-direction anemometer 321*ba* (or 321*bb*) transmits ultrasonic waves to the other y-direction anemometer 321*bb* (or 321*ba*) disposed in parallel in a y-direction. The other y-direction anemometer 321*bb* (or 321*ba*) receives the ultrasonic waves transmitted from one y-direction anemometer 321*ba* (or 321*bb*).

Wind direction and wind velocity detector 311 detects wind direction and wind velocity around omnidirectional microphone array device 2*kb* on the basis of outputs of x-direction anemometers 321*aa* and 321*ab* and outputs of y-direction anemometers 321*ba* and 321*bb*, and outputs measured values of wind direction and wind velocity to controller 281. Meanwhile, since a method of measuring wind direction and wind velocity with wind direction and wind velocity detector 311, x-direction anemometers 321*aa* and 321*ab*, and y-direction anemometers 321*ba* and 321*bb* is a known technique, a description thereof will be omitted here.

Controller 281 acquires measured values of temperature detector TS, humidity detector HS, atmospheric pressure detector AS, and wind direction and wind velocity detector 311, outputs the acquired measured values to transmitter 291, and gives an instruction for adding the measured values to packet PKT (see FIG. 6A). Transmitter 291 generates packet PKT illustrated in FIG. 6A using various pieces of data (specifically, sound data, temperature data, humidity data, atmospheric pressure data, and data of wind direction and wind velocity) which are acquired from controller 281 and transmits the generated packet to directivity control device 3 and recorder device 4.

Figure 13A:
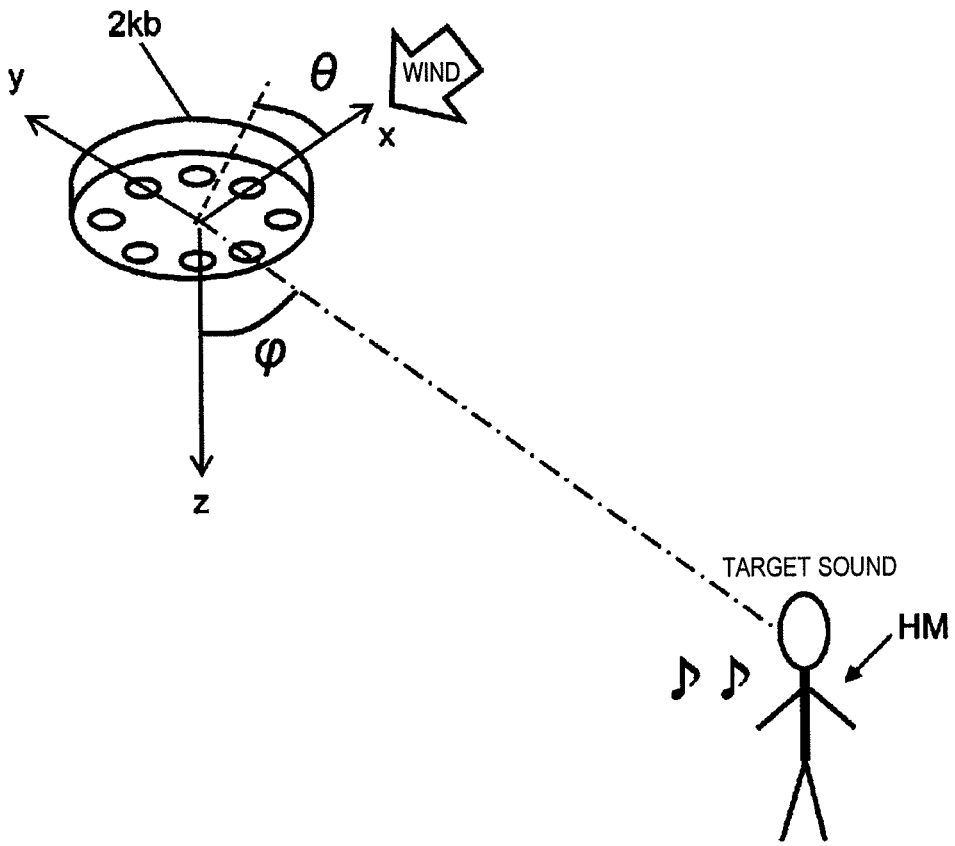
FIG. 13A is a diagram illustrating changes in sound velocity in a case where a target sound is emitted in a direction ($\theta$, $\phi$), when seen from an omnidirectional microphone array device, and wind is blowing from a +x-direction of an x-y plane.

Here, correction of sound velocity Vs using wind direction and wind velocity will be described with reference to FIG. 13A. FIG. 13A is a diagram illustrating changes in sound velocity in a case where a target sound is emitted in a direction of (θ, ϕ), when seen from omnidirectional microphone array device 2*kb*, and wind is blowing from a +x-direction of an x-y plane.

When a target sound (for example, sound "♪♪" emitted by person HM) is present in a direction of (θ, ϕ) (sound collection direction) from omnidirectional microphone array device 2*kb* and wind blows in a +x-direction of an x-y plane, sound velocity Vs changes by vector components in the sound collection direction of wind velocity Vw. For this reason, as expressed as Expression (7), velocity based on the wind direction and wind velocity Vw are added to or subtracted from sound velocity Vs (see Expression (4)) which is calculated using temperature data, humidity data, and atmospheric pressure data. The first term on the right side of Expression (7) is wind velocity Vs which is calculated in accordance with Expression (4).

$$Vs'=Vs(T,P,H)+Vw\times\cos\theta\times\cos\phi \quad (7)$$

Figure 13B:
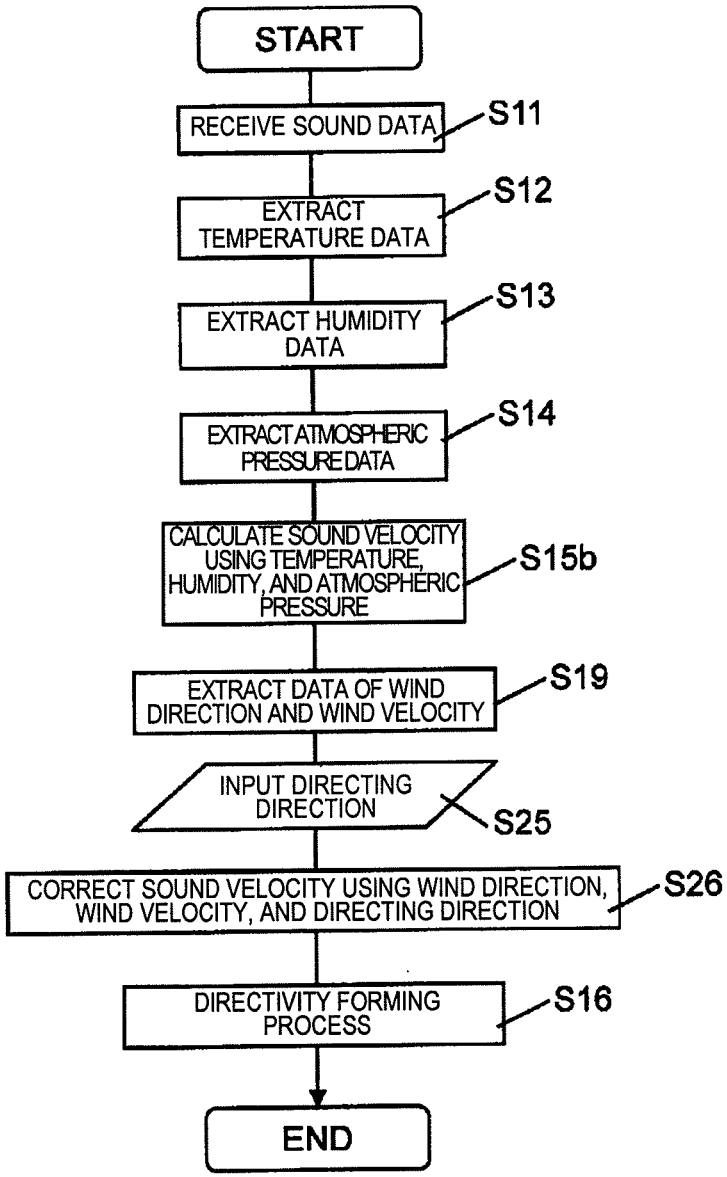
FIG. 13B is a flow chart illustrating a fourth example of an operation procedure of a directivity control device.

FIG. 13B is a flow chart illustrating a fourth example of an operation procedure of directivity control device 3. In FIG. 13B, a description is given of a process of correcting wind velocity Vs using temperature data, humidity data, atmospheric pressure data, and data of wind direction and wind velocity which are measured values of environmental parameters included in packet PKT transmitted from omnidirectional microphone array device 2*kb* to thereby calculate wind velocity Vs'.

In FIG. 13B, the same operations as the operations in FIG. 7B are denoted by the same step numbers, a description thereof will be simplified or omitted, and different contents will be described. In directivity control device 3, sound velocity corrector 34*b* calculates sound velocity Vs necessary for the formation of the directivity of sound data using temperature data, humidity data, and atmospheric pressure data after step S14 is performed (S15*b*). Further, sound velocity corrector 34*b* extracts data of wind direction and wind velocity from packet PKT transmitted from omnidirectional microphone array device 2*kb* (S19). After step S19 is performed, the directing direction (that is, a sound collection direction (θ, ϕ) illustrated in FIG. 13A) is input from operator 32 by a user's operation (S25). Next, sound velocity corrector 34*b* calculates wind velocity Vs' in accordance with Expression (7) using the data of the wind direction and the wind velocity extracted in step S19 and the directing direction (θ, ϕ) input in step S25 (S26). The operation subsequent to step S26 is the same as step S16 of FIG. 7B, and thus a description thereof will be omitted here.

As described above, in the fourth example of the calculation of sound velocity Vs, directivity control device 3 as an example of a sound velocity correction device according to the disclosure corrects sound velocity Vs to sound velocity Vs' using data of measured values of temperature, humidity, and atmospheric pressure which are environmental parameters and data of measured values of wind direction and wind velocity around omnidirectional microphone array device 2*kb*. Thus, even when omnidirectional microphone array device 2*kb* is installed at a place (for example, outdoors or in the vicinity of air conditioner or a ventilating opening) which tends to be influenced by wind, it is possible to accurately calculate a sound velocity in view of not only the measured values (temperature data, humidity data, atmospheric pressure data) of environmental parameters but also the measured values of the wind direction and the wind velocity.

Fifth Example of Calculation of Sound Velocity Vs

Figure 14A:
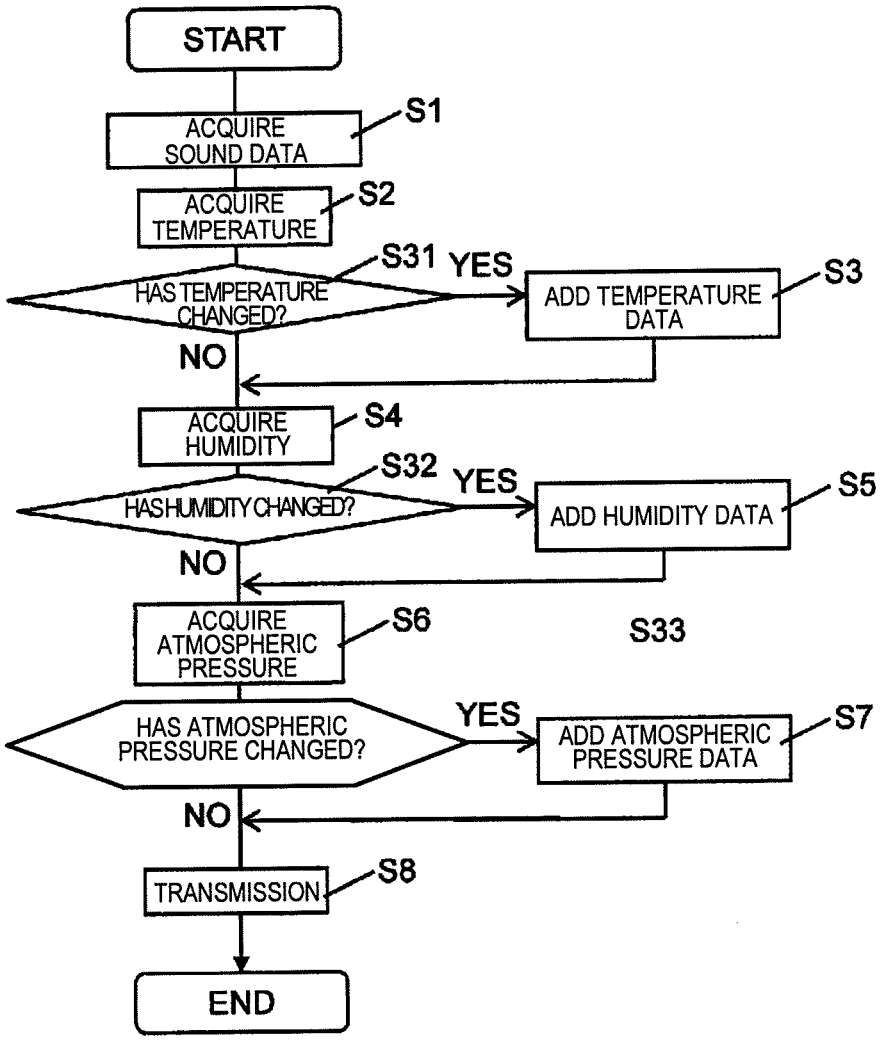
FIG. 14A is a flow chart illustrating a fifth example of an operation procedure of an omnidirectional microphone array device.

In the present exemplary embodiment, only when each of measured values of temperature, humidity, and atmospheric pressure which are environmental parameters has changed by a predetermined amount or more, omnidirectional microphone array device 2 may transmit the measured value of an environmental parameter which has changed by a predetermined amount or more to directivity control device 3 and recorder device 4 (see FIG. 14A). FIG. 14A is a flow chart illustrating a fifth example of an operation procedure of omnidirectional microphone array device 2. In the description of FIG. 14A, the same operations as the operations in FIG. 6B are denoted by the same step numbers, a description thereof will be simplified or omitted, and different contents will be described.

In FIG. 14, in omnidirectional microphone array device 2, controller 281 determines whether or not temperature data acquired in step S2 has changed by a predetermined amount (for example, 1 [° C.]) or more based on the temperature data (S31). When the temperature data has changed by a predetermined amount or more (S31, YES), the controller outputs the temperature data, indicating a measured value of temperature, which is acquired in step S2 to transmitter 291 and gives an instruction for the adding of the temperature data to packet PKT (S3). On the other hand, when the temperature data has not changed by a predetermined amount or more (S31, NO), the processing of controller 281 proceeds to step S4.

Controller 281 determines whether or not humidity data acquired in step S4 has changed by a predetermined amount (for example, 10 [%]) or more based on the humidity data (S32). When the humidity data has changed by a predetermined amount or more (S32, YES), the controller outputs the humidity data, indicating a measured value of humidity, which is acquired in step S4 to transmitter 291 and gives an instruction for the adding of the humidity data to packet PKT (S5). On the other hand, when the humidity data has not changed by a predetermined amount or more (S32, NO), the processing of controller 281 proceeds to step S6.

Similarly, controller 281 determines whether or not atmospheric pressure data acquired in step S6 has changed by a predetermined amount (for example, 0.1 [atmospheric pressure]) or more based on the atmospheric pressure data (S33). When the atmospheric pressure data has changed by a predetermined amount or more (S33, YES), the controller outputs the atmospheric pressure data, indicating a measured value of atmospheric pressure, which is acquired in step S6 to transmitter 291 and gives an instruction for the adding of the atmospheric pressure data to packet PKT (S7). On the other hand, when the atmospheric pressure data has not changed by a predetermined amount or more (S33, NO), the processing of controller 281 proceeds to step S8. The process of step S8 is the same as that in FIG. 6B, and thus a description thereof will be omitted here.

Figure 14B:
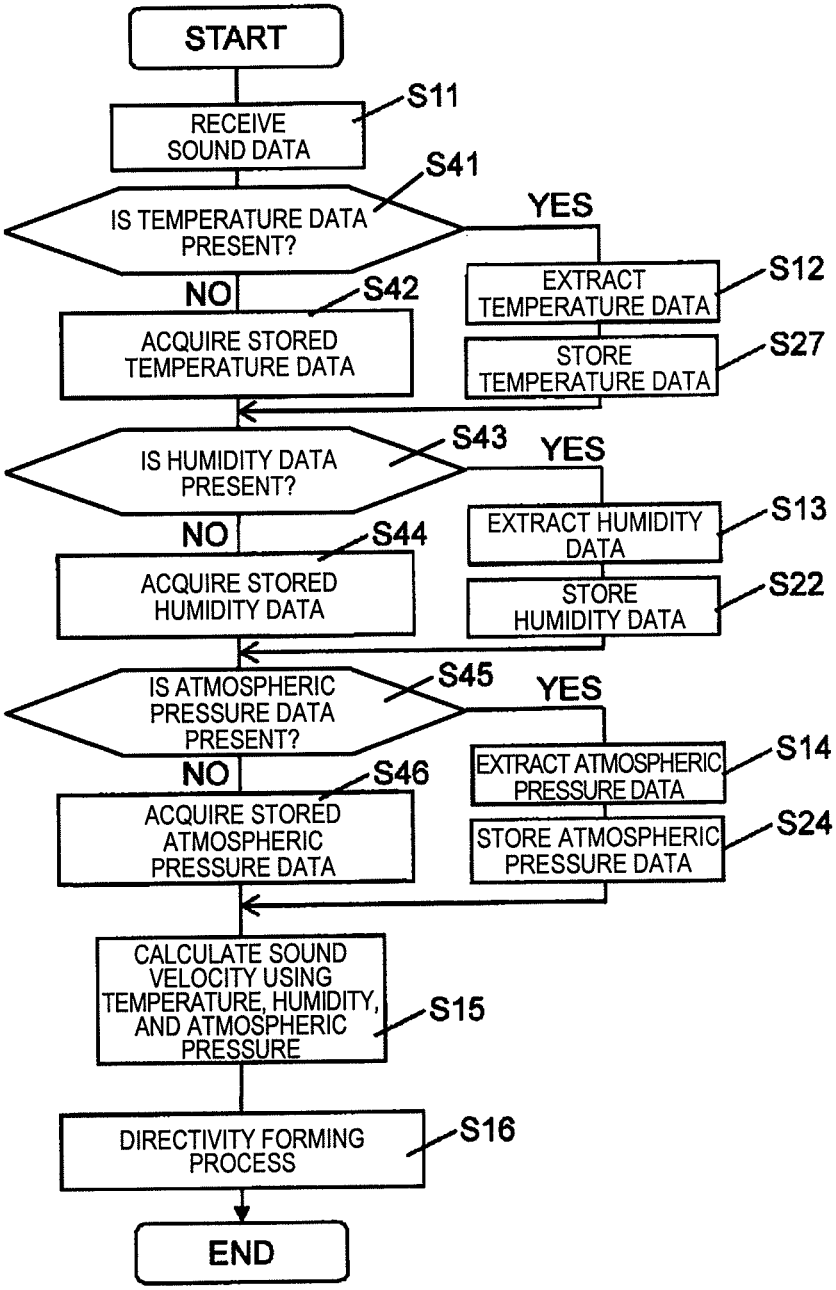
FIG. 14B is a flow chart illustrating a fifth example of an operation procedure of a directivity control device.

FIG. 14B is a flow chart illustrating a fifth example of an operation procedure of directivity control device 3. In the description of FIG. 14B, the same operations as the operations in FIG. 7B are denoted by the same step numbers, a description thereof will be simplified or omitted, and different contents will be described.

In FIG. 14B, after step S11 is performed, sound velocity corrector 34*b* determines whether or not temperature data is included in packet PKT received by communicator 31 in step S11 (S41). When it is determined that the temperature data is included (S41, YES), the temperature data is extracted and is stored in memory 38 (S12, S27). On the other hand, when the temperature data is not included (S41, NO), sound velocity corrector 34*b* acquires the temperature data (that is, temperature data, measured last time, which has not changed by a predetermined amount or more) which is stored in memory 38 (S42).

Sound velocity corrector 34*b* determines whether or not humidity data is included in packet PKT received by communicator 31 in step S11 (S43). When it is determined that the humidity data is included (S43, YES), the humidity data is extracted and is stored in memory 38 (S13, S22). On the other hand, when the humidity data is not included (S43, NO), sound velocity corrector 34*b* acquires the humidity data (that is, humidity data, measured last time, which has not changed by a predetermined amount or more) which is stored in memory 38 (S44).

Similarly, sound velocity corrector 34*b* determines whether or not atmospheric pressure data is included in packet PKT received by communicator 31 in step S11 (S45). When it is determined that the atmospheric pressure data is included (S45, YES), the atmospheric pressure data is extracted and is stored in memory 38 (S14, S24). On the other hand, when the atmospheric pressure data is not included (S45, NO), sound velocity corrector 34*b* acquires the atmospheric pressure data (that is, atmospheric pressure data, measured last time, which has not changed by a predetermined amount or more) which is stored in memory 38 (S46). The operations subsequent to step S24 or step S46 are the same as the operation in step S15 and the subsequent operations illustrated in FIG. 7B, and thus a description thereof will be omitted here.

As described above, in the fifth example of the calculation of sound velocity Vs, only when each of measured values of temperature, humidity, and atmospheric pressure which are environmental parameters periodically measured has changed by a predetermined amount or more based on each measured value, directivity control device 3 as an example of a sound velocity correction device according to the disclosure corrects a sound velocity using the changed measured values of the environmental parameters. Accordingly, it is possible to reduce the number of times of correction of the sound velocity under an environment where surrounding environmental parameters do not change frequently and to reduce processing load required for the correction of a sound velocity.

Sixth Example of Calculation of Sound Velocity Vs

Figure 15:
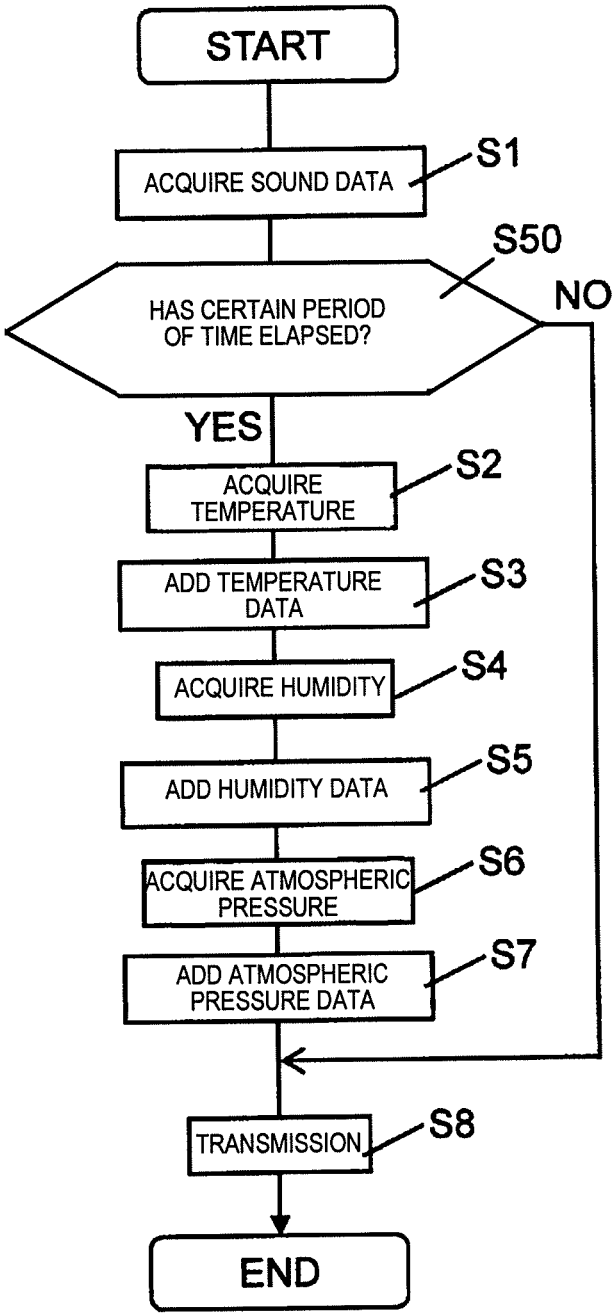
FIG. 15 is a flow chart illustrating a sixth example of an operation procedure of an omnidirectional microphone array device.

In the present exemplary embodiment, only when a certain period of time elapses after temperature, humidity, and atmospheric pressure which are environmental parameters are measured, omnidirectional microphone array device 2 may transmit temperature data, humidity data, and atmospheric pressure data which are measured values of the environmental parameters to directivity control device 3 and recorder device 4 (see FIG. 15). FIG. 15 is a flow chart illustrating a sixth example of an operation procedure of omnidirectional microphone array device 2. In the description of FIG. 15, the same operations as the operations in FIG. 6B are denoted by the same step numbers, a description thereof will be simplified or omitted, and different contents will be described.

In FIG. 15, controller 281 determines whether or not a certain period of time has elapsed after sound data is acquired in step S1 and temperature detector TS, humidity detector HS, and atmospheric pressure detector AS measure temperature, humidity, and atmospheric pressure, respectively (S50). Only when a certain period of time has elapsed (S50, YES), the processes of step S2 to step S7 (see FIG. 6B) are performed in the operation of omnidirectional microphone array device 2. On the other hand, when a certain period of time has not elapsed (S50, NO), the processes of step S2 to step S7 are omitted, and the process of step S8 is performed. Meanwhile, the operation of directivity control device 3 is the same as the operations of the flow chart illustrated in FIG. 14B, and thus a description thereof will be omitted here.

As described above, in the sixth example of the calculation of sound velocity Vs, since the next measurement is not performed before a certain period of time elapses after temperature, humidity, and atmospheric pressure which are environmental parameters are measured, directivity control device 3 as an example of a sound velocity correction device according to the disclosure can reduce the number of times of the correction of a sound velocity and to reduce processing load required for the correction of a sound velocity because a sound velocity hardly changes even when the number of times of the measurement of temperature, humidity, and atmospheric pressure which are environmental parameters is reduced under an environment where surrounding environmental parameters do not change frequently.

Meanwhile, when there is no environmental parameter information when an operation is started, directivity control device 3 may calculate the directing direction from a reference sound velocity which is set in memory 38 in advance.

Second Exemplary Embodiment

Figure 16A:
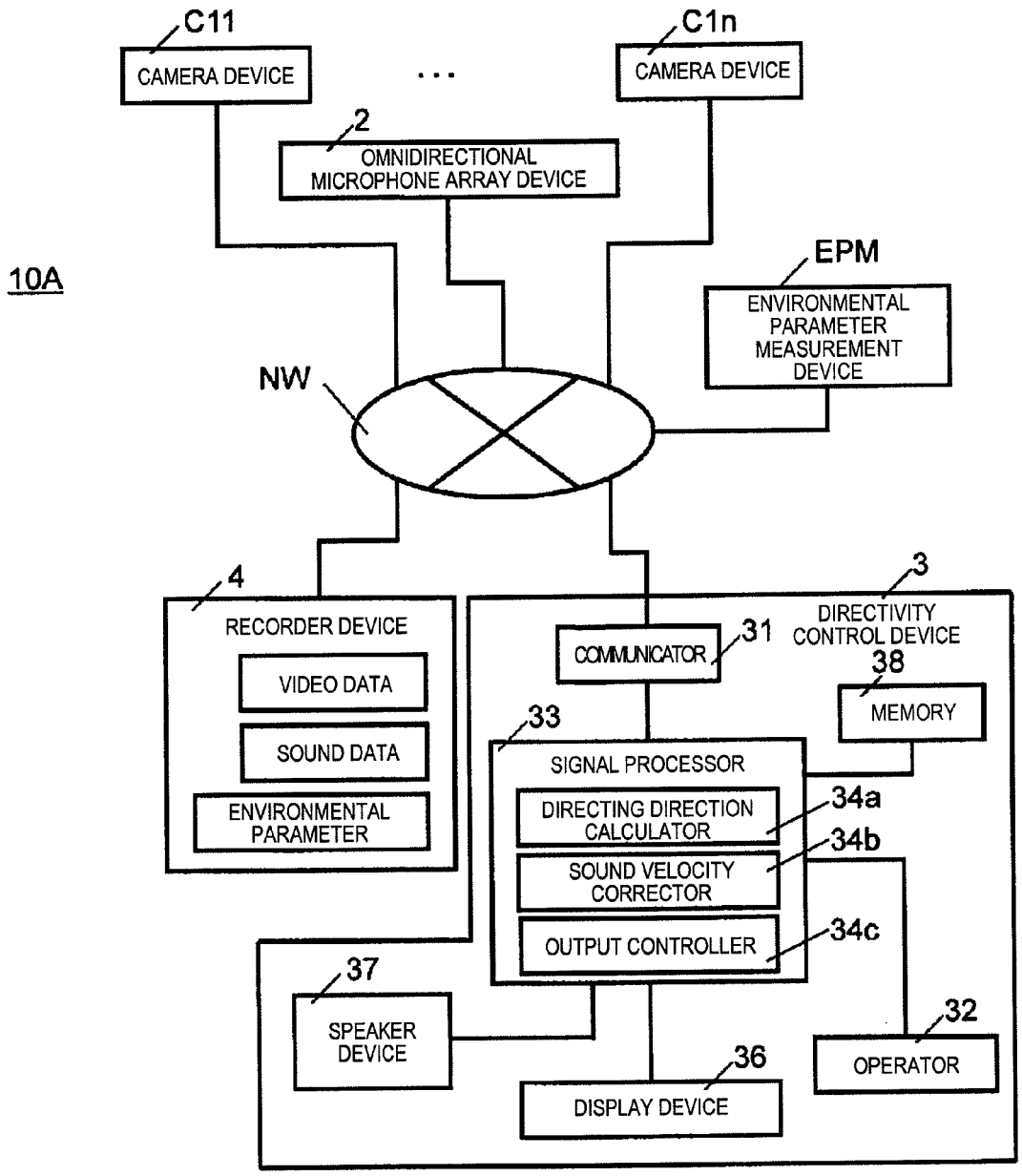
FIG. 16A is a block diagram illustrating a system configuration of a directivity control system according to a second exemplary embodiment.

FIG. 16A is a block diagram illustrating a system configuration of directivity control system 10A according to a second exemplary embodiment. Directivity control system 10A illustrated in FIG. 16A is configured such that environmental parameter measurement device EPM is added to directivity control system 10 illustrated in FIG. 1. Configurations other than that of environmental parameter measurement device EPM are the same as configurations of the units illustrated in FIG. 1, and thus a description thereof will be omitted here.

Figure 16B:
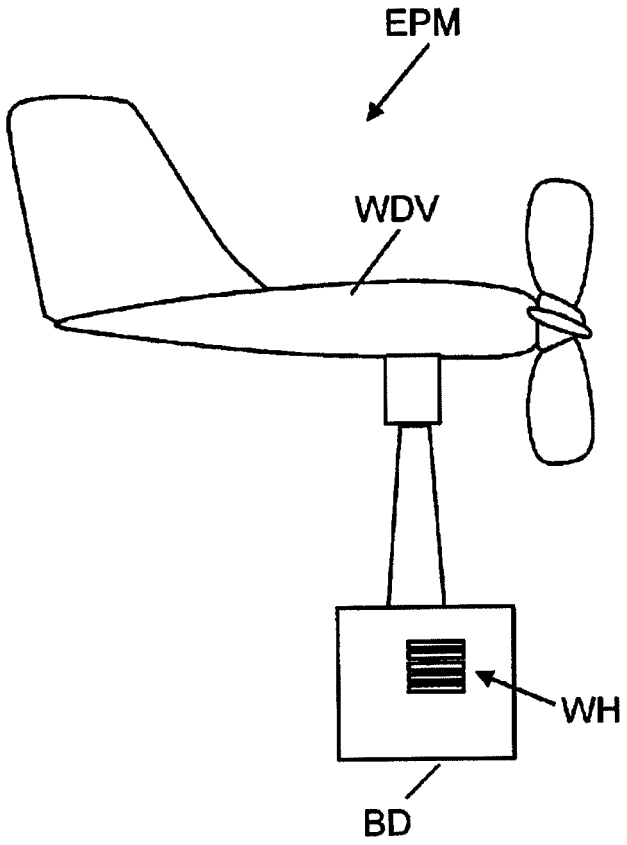
FIG. 16B is a diagram illustrating an example of an environmental parameter measurement device which is installed, for example, outdoors.

FIG. 16B is a diagram illustrating an example of environmental parameter measurement device EPM installed, for example, outdoors. In environmental parameter measurement device EPM, vent hole WH is provided in housing BD. Wind direction anemometer WDV capable of measuring wind direction and wind velocity is connected to housing BD. For example, temperature humidity atmospheric pressure measurement element 161 including temperature detector TS, humidity detector HS, and atmospheric pressure detector AS illustrated in FIG. 4 is disposed inside housing BD (not shown). Accordingly, in the present exemplary embodiment, temperature data, humidity data, atmospheric pressure data, and data of wind direction and wind velocity are measured by environmental parameter measurement device EPM which is a separate body, instead of measuring temperature data, humidity data, and atmospheric pressure data by omnidirectional microphone array device 2 as in the first exemplary embodiment.

Seventh Example of Calculation of Sound Velocity Vs

Figure 17A:
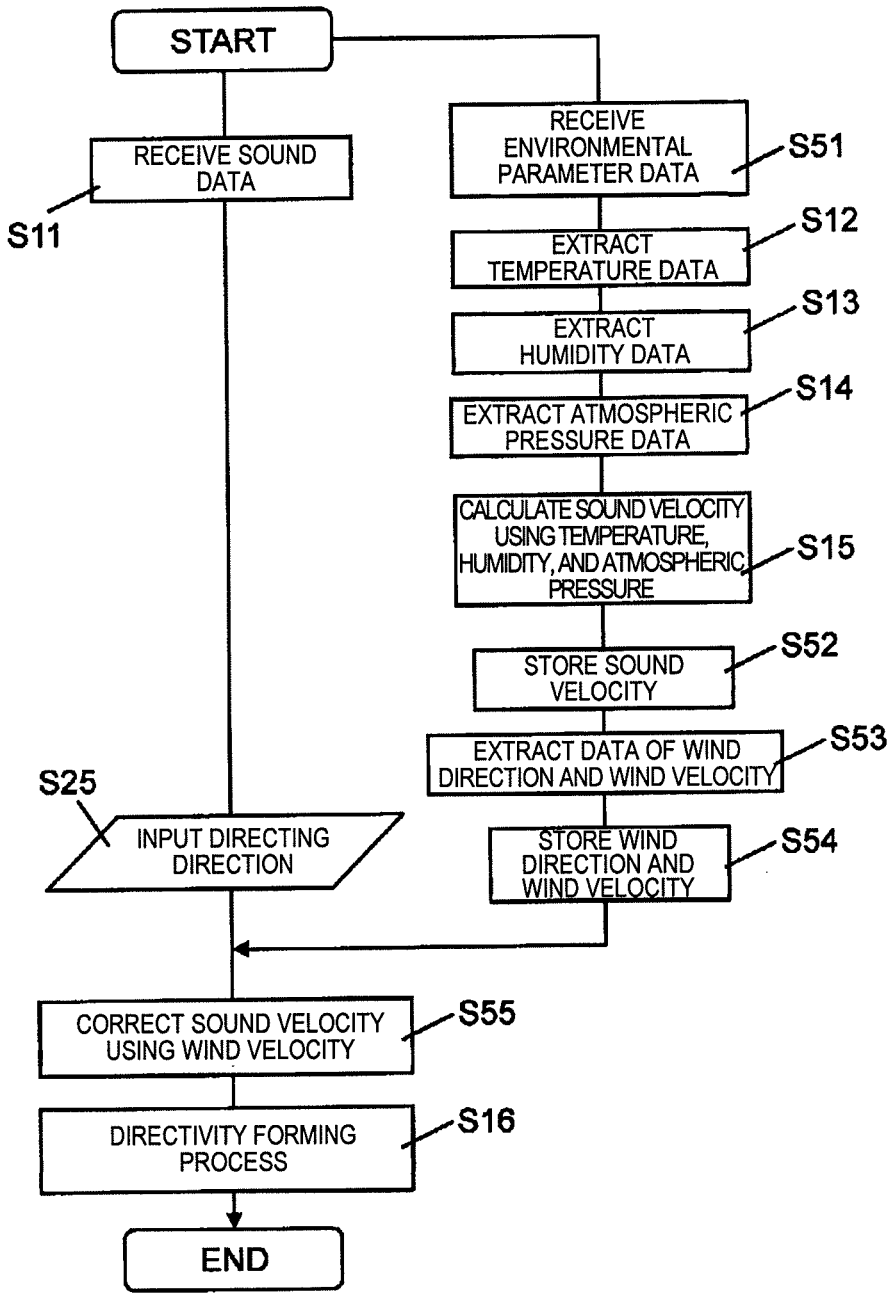
FIG. 17A is a flow chart illustrating a seventh example of an operation procedure of a directivity control device.
Figure 17B:
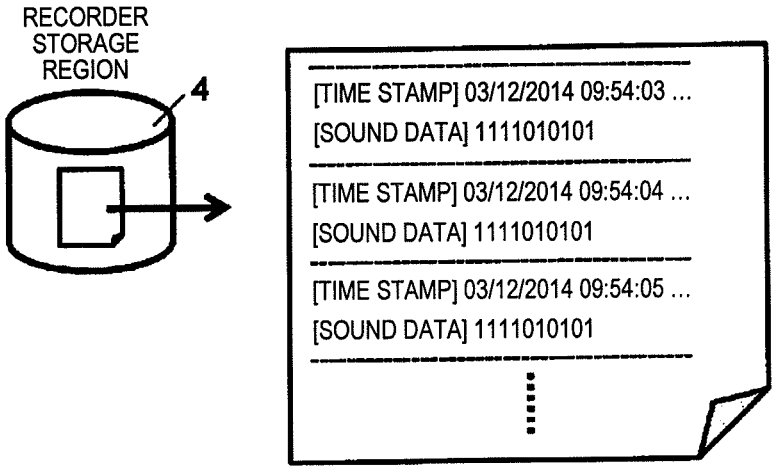
FIG. 17B is a diagram illustrating an example of data stored in a recorder storage region of a recorder device illustrated in FIG. 17A.
Figure 17C:
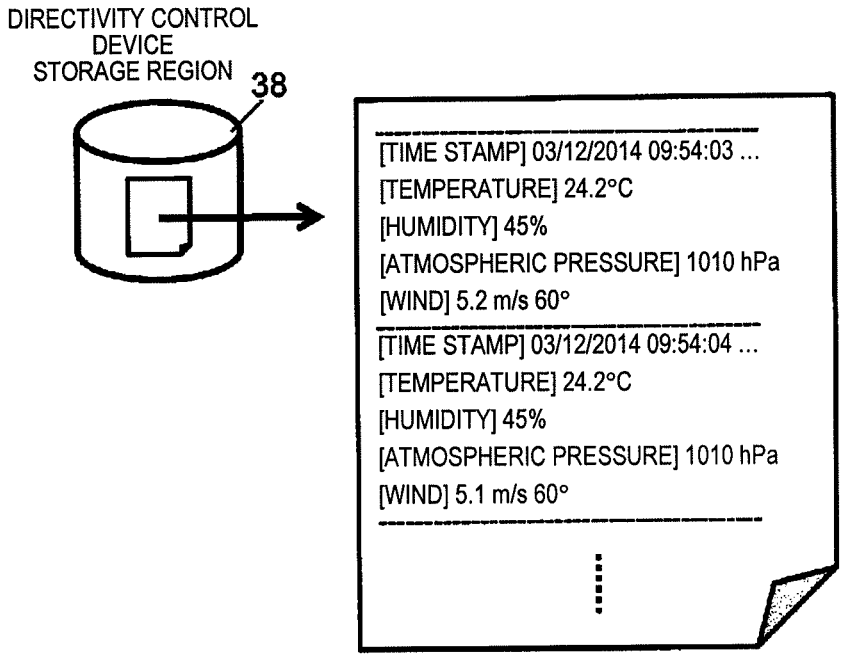
FIG. 17C is a diagram illustrating an example of data stored in a storage region of the directivity control device illustrated in FIG. 17A.

FIG. 17A is a flow chart illustrating a seventh example of an operation procedure of directivity control device 3. FIG. 17B is a diagram illustrating an example of data stored in a recorder storage region of recorder device 4 illustrated in FIG. 17A. FIG. 17C is a diagram illustrating an example of data stored in a storage region of the directivity control device illustrated in FIG. 17A. In the description of FIG. 17A, the same operations as the operations in FIG. 7B are denoted by the same step numbers, a description thereof will be simplified or omitted, and different contents will be described.

In FIG. 17A, communicator 31 receives sound data included in packet PKT transmitted from omnidirectional microphone array device 2 and outputs the received sound data to signal processor 33 (S11). Further, the communicator receives temperature data, humidity data, atmospheric pressure data, and data of wind direction and wind velocity which are included in the same packet PKT and outputs the received data to signal processor 33 (S51).

Sound velocity corrector 34*b* calculates sound velocity Vs in accordance with Expression (4) using temperature data extracted in step S12, humidity data extracted in step S13, and atmospheric pressure data extracted in step S14 (S15), and stores data of the calculated sound velocity Vs in memory 38 (S52). Further, sound velocity corrector 34*b* extracts the data of the wind direction and the wind velocity which is acquired from communicator 31 in step S51 and stores the extracted data in memory 38 (S53, S54).

After the directing direction (that is, the sound collection direction ($\theta$, $\phi$) illustrated in FIG. 13A) is input from operator 32 by a user's operation (S25) after step S11 is performed, sound velocity corrector 34*b* corrects sound velocity Vs to sound velocity Vs' in accordance with Expression (7) using the data of sound velocity Vs stored in memory 38 in step S52 and the data of the wind direction and the wind velocity stored in memory 38 in step S54 (S55). The operation subsequent to step S55 is the same as step S16 illustrated in FIG. 7B, and thus a description thereof will be omitted here.

As illustrated in FIG. 17B, in a recorder storage region of recorder device 4 according to the present exemplary embodiment, pieces of data transmitted from omnidirectional microphone array device 2 are a time stamp and sound data, and thus sound data and a time stamp are stored in association with each other for each record.

As illustrated in FIG. 17C, in a storage region of memory 38 of directivity control device 3 according to the present exemplary embodiment, pieces of data transmitted from omnidirectional microphone array device 2 include temperature data, humidity data, atmospheric pressure data, and data of wind direction and wind velocity which are measured values of environmental parameters. For this reason, temperature data, humidity data, atmospheric pressure data, data of wind direction and wind velocity, and a time stamp are stored in association with each other for each record. Meanwhile, pieces of data stored in recorder device 4 and directivity control device 3 are associated with each other by a time stamp. Accordingly, when directivity control device 3 acquires sound data stored in recorder device 4 and outputs the acquired sound data from speaker device 37, the directivity control device acquires sound data having the same time stamp from recorder device 4.

As described above, in directivity control system 10A according to the present exemplary embodiment, directivity control device 3 as an example of a sound velocity correction device according to the disclosure corrects sound velocity Vs to sound velocity Vs' using pieces of data of measured values of temperature, humidity, atmospheric pressure, and wind direction and wind velocity which are environmental parameters measured by environmental parameter measurement device EPM. Thus, even when omnidirectional microphone array device 2*kb* is installed at a place (for example, outdoors or in the vicinity of air conditioner or a ventilation opening) which tends to be influenced by wind, it is possible to accurately calculate a sound velocity in view of not only the measured values (temperature data, humidity data, atmospheric pressure data) of environmental parameters but also the measured values of the wind direction and the wind velocity.

When omnidirectional microphone array device 2 is installed outdoors, the omnidirectional microphone array device is affected by wind. Thus, not only a change in sound velocity but also the occurrence of an error of a sound source direction due to the bending of a propagation path of sound waves, in other words, a change in an incident angle of a sound wave incident on each microphone element of omnidirectional microphone array device 2 is considered.

Consequently, for example, camera device C11 estimates a distance between camera device C11 and a sound source on the basis of an image obtained by camera device C11, calculates a transmission time of sound waves using the estimated value of the distance between camera device C11 and the sound source and corrected sound velocity Vs', and transmits the calculated transmission time to omnidirectional microphone array device 2. Omnidirectional microphone array device 2 may correct an incident angle of a sound wave incident on each microphone element using the transmission time transmitted from camera device C11.

Eighth Example of Calculation of Sound Velocity Vs

Figure 18:
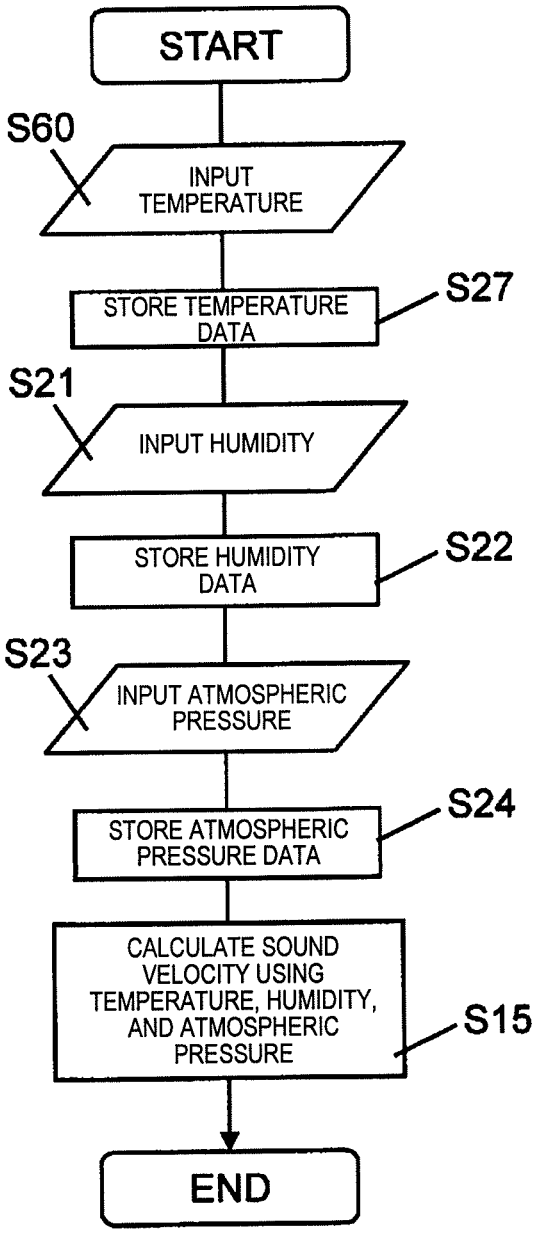
FIG. 18 is a flow chart illustrating another example of an operation procedure of initial setting for setting pieces of data of environmental parameters in a directivity control device.

Meanwhile, in the first exemplary embodiment, in an environment that does not significantly change, for example, because omnidirectional microphone array device 2 is installed indoors, in other words, in an environment where temperature data, humidity data, and atmospheric pressure data which are environmental parameters are not likely to change, an average value of the temperature data, the humidity data, and the atmospheric pressure data which are environmental parameters may be input during initial setting, and a sound velocity may be corrected using the input value (see FIG. 18).

FIG. 18 is a flow chart illustrating another example of an operation procedure of initial setting for setting pieces of data of environmental parameters in directivity control device 3. In the description of FIG. 18, the same operations as the operations in FIG. 10A are denoted by the same step numbers, a description thereof will be simplified or omitted, and different contents will be described.

In FIG. 18, when temperature data (for example, an initial setting value of temperature which is measured in advance) is input from operator 32 by a user's operation (S60), signal processor 33 stores (saves) the temperature data input in step S60 in memory 38 (S27). After step S24 is performed, sound velocity corrector 34*b* calculates sound velocity Vs necessary for the formation of the directivity of sound data in accordance with Expression (4) using the temperature data, the humidity data, and the atmospheric pressure data which are stored in memory 38 in step S27, step S22, and step S24 (S15).

As described above, in the eighth example of the calculation of sound velocity Vs, when a difference between a measured value of an environmental parameter which is periodically measured and a predetermined setting value (for example, an initial setting value) of the environmental parameter is less than a predetermined value, directivity control device 3 as an example of a sound velocity correction device according to the disclosure corrects a sound velocity using not the measured value of the environmental parameter, but the predetermined setting value. Accordingly, it is possible to reduce the number of times of correction of the sound velocity under an environment (for example, indoors) where surrounding environmental parameters do not change frequently and to reduce a processing load required for the correction of a sound velocity.

Ninth Example of Calculation of Sound Velocity Vs

Figure 19:
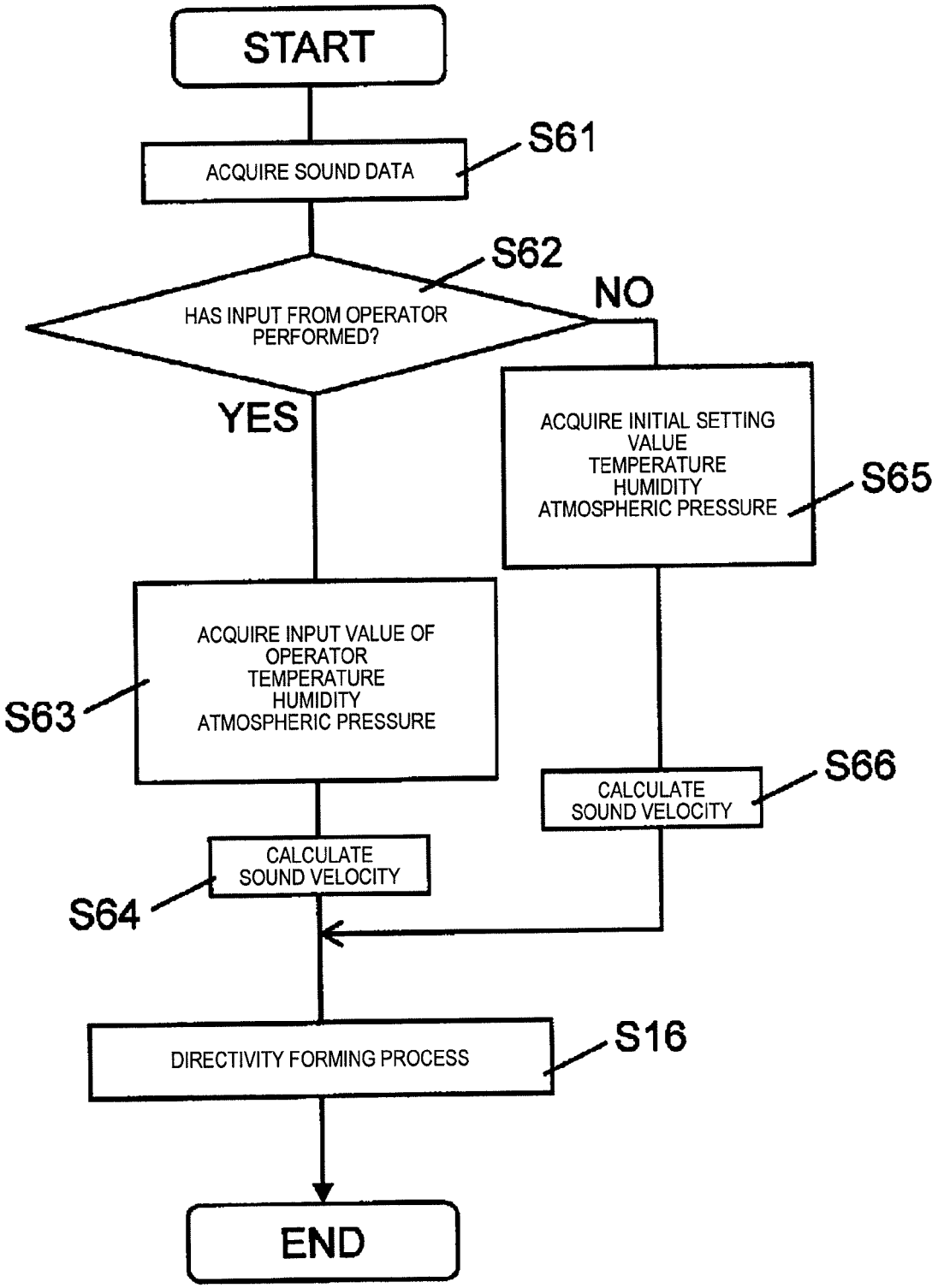
FIG. 19 is a flow chart illustrating a ninth example of an operation procedure of a directivity control device.

Initial setting values of temperature data, humidity data, and atmospheric pressure data which are environmental parameters are input in advance during initial setting. When an environment during sound collection performed by omnidirectional microphone array device 2 is significantly different from that during initial setting, sound velocity corrector 34*b* may calculate (correct) sound velocity Vs using the temperature data, the humidity data, and the atmospheric pressure data which are environmental parameters which are input from operator 32 by a user's operation (see FIG. 19). FIG. 19 is a flow chart illustrating a ninth example of an operation procedure of directivity control device 3. In the description of FIG. 19, the same operations as the operations illustrated in FIG. 7B are denoted by the same step numbers, a description thereof will be simplified or omitted, and different contents will be described.

In FIG. 19, communicator 31 receives packet PKT (that is, sound data, temperature data, humidity data, atmospheric pressure data and a time stamp) which is transmitted from omnidirectional microphone array device 2 and outputs the received packet to signal processor 33 (S61). Meanwhile, temperature data, humidity data, and atmospheric pressure data may be omitted in packet PKT received by communicator 31 in step S61.

When temperature data, humidity data, and atmospheric pressure data which are environmental parameters are input from operator 32 by a user's operation after step S61 is performed (S62, YES), sound velocity corrector 34*b* acquires the input values of the temperature data, the humidity data, and the atmospheric pressure data (S63), and calculates sound velocity Vs in accordance with Expression (4) to Expression (6) (S64).

On the other hand, when temperature data, humidity data, and atmospheric pressure data which are environmental parameters are not input from operator 32 by a user's operation (S62, NO), sound velocity corrector 34*b* acquires predetermined setting values (for example, initial setting values) of temperature data, humidity data, and atmospheric pressure data which are stored in memory 38 in advance (S65), and calculates sound velocity Vs in accordance with Expression (4) to Expression (6) (S66). The operation subsequent to step S64 or step S66 is the same as step S16 illustrated in FIG. 7B, and thus a description thereof will be omitted here.

As described above, in the ninth example of the calculation of sound velocity Vs, only when temperature data, humidity data, and atmospheric pressure data which are measured values of environmental parameters are input from operator 32, directivity control device 3 as an example of a sound velocity correction device according to the disclosure corrects sound velocity Vs using the input values of the temperature data, the humidity data, and the atmospheric pressure data. Accordingly, measured values of environmental parameters may not be input under user's determination, for example, in an environment where surrounding environmental parameters do not change frequently. Thus, it is possible to reduce the number of times of correction of the sound velocity and to reduce processing load required for the correction of a sound velocity, unlike in a case where a sound velocity is corrected using periodic measured values of environmental parameters.

Third Exemplary Embodiment

Figure 20:
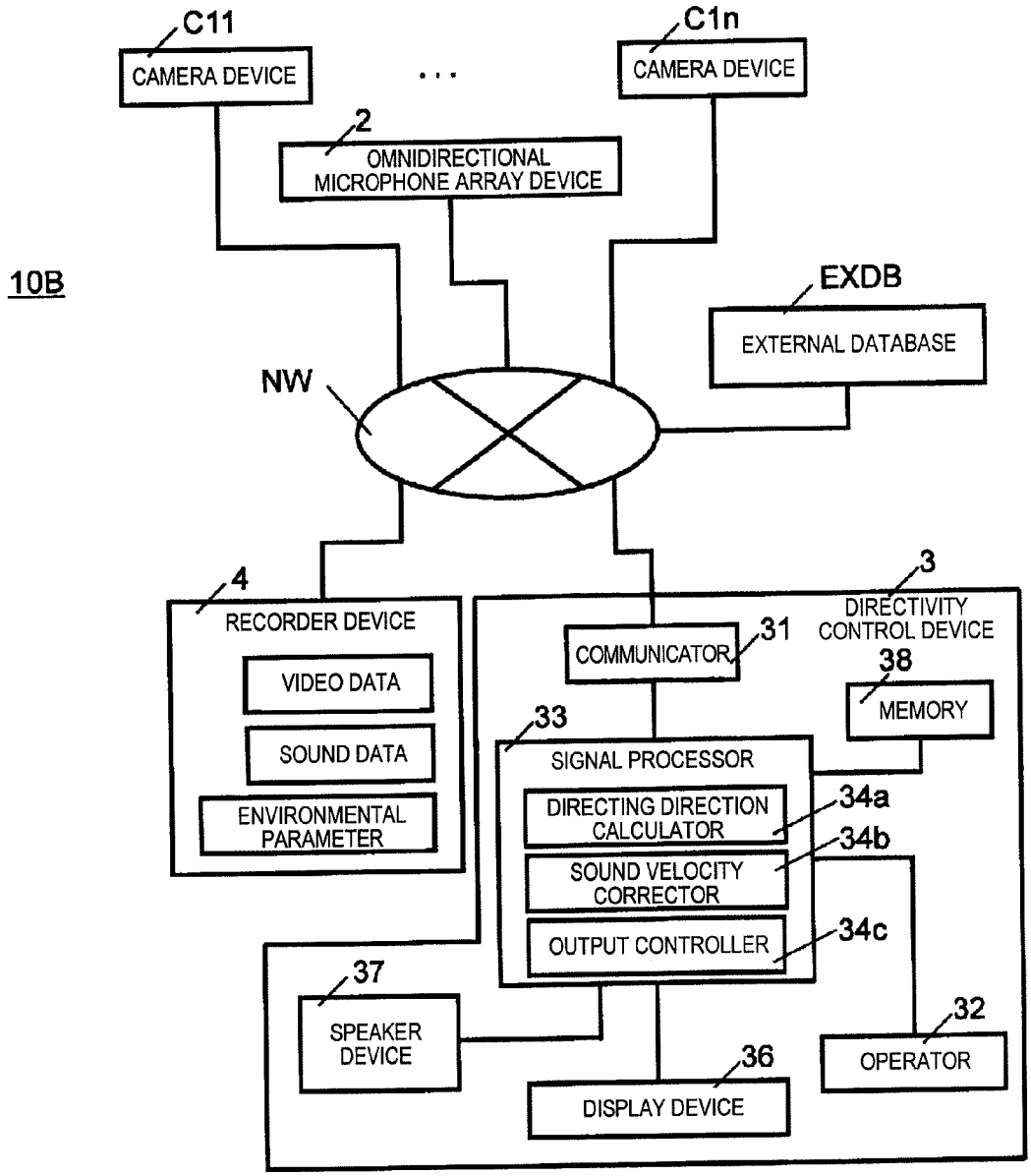
FIG. 20 is a block diagram illustrating a system configuration of a directivity control system according to a third exemplary embodiment.

FIG. 20 is a block diagram illustrating a system configuration of directivity control system 10B according to a third exemplary embodiment. Directivity control system 10B illustrated in FIG. 20 is configured such that external database EXDB as an example of a database is added to directivity control system 10 illustrated in FIG. 1. Configurations other than that of external database EXDB are the same as configurations of the units illustrated in FIG. 1, and thus a description thereof will be omitted here. External database EXDB is a database that manages and stores temperature data, humidity data, atmospheric pressure data, and data of wind direction and wind velocity which are environmental parameters for each region in association with a time stamp (that is, a measurement date and time and a measurement time).

Tenth Example of Calculation of Sound Velocity Vs

Figure 21A:
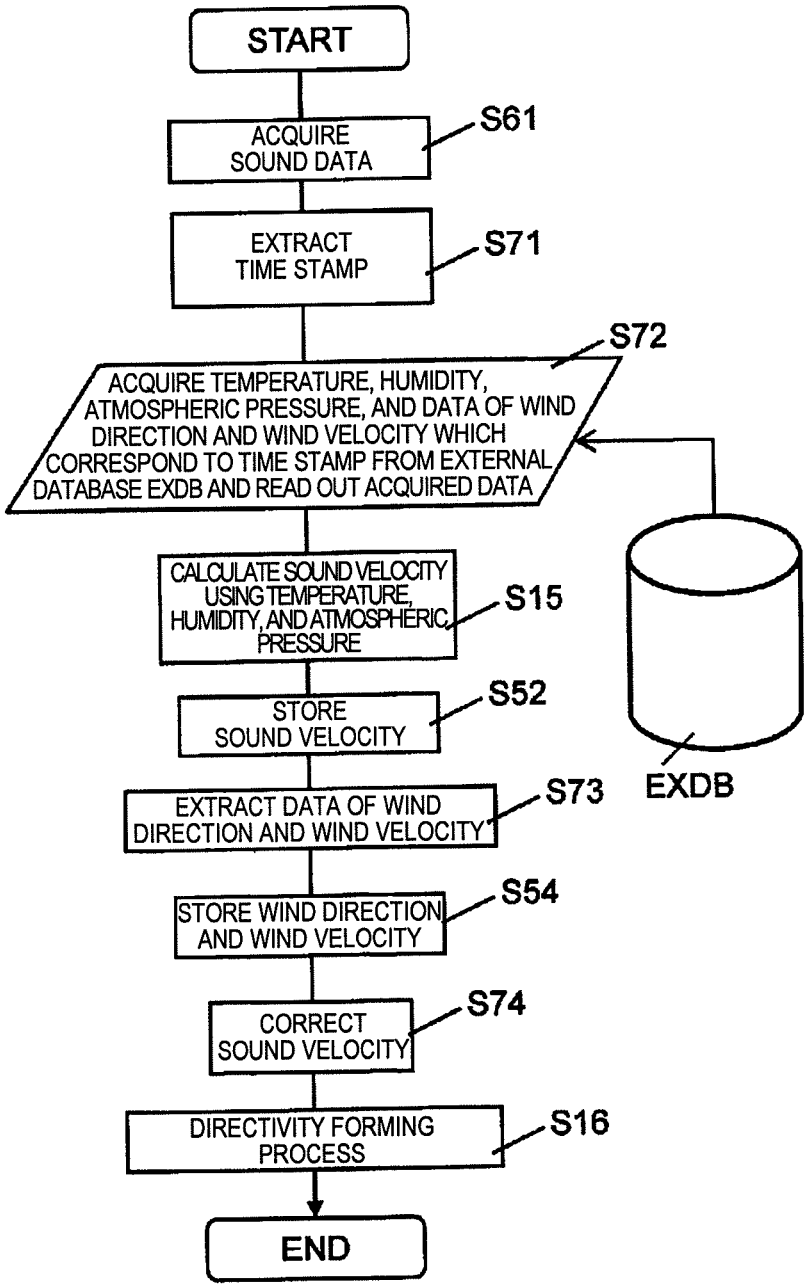
FIG. 21A is a flow chart illustrating a tenth example of an operation procedure of a directivity control device.
Figure 21B:
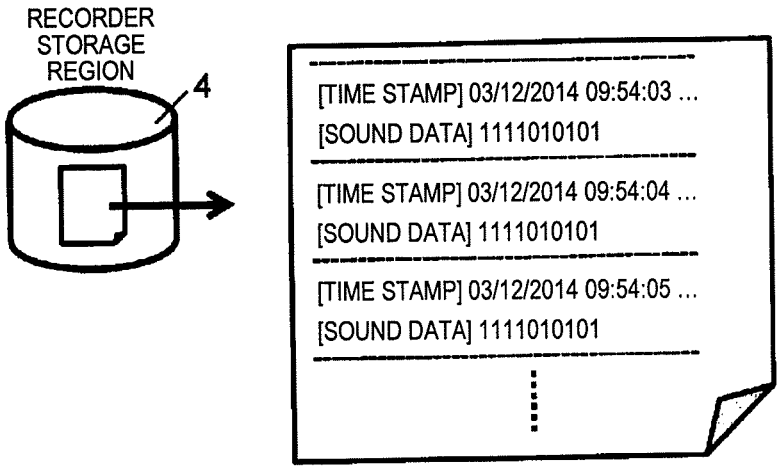
FIG. 21B is a diagram illustrating an example of data stored in a recorder storage region of a recorder device illustrated in FIG. 20.
Figure 21C:
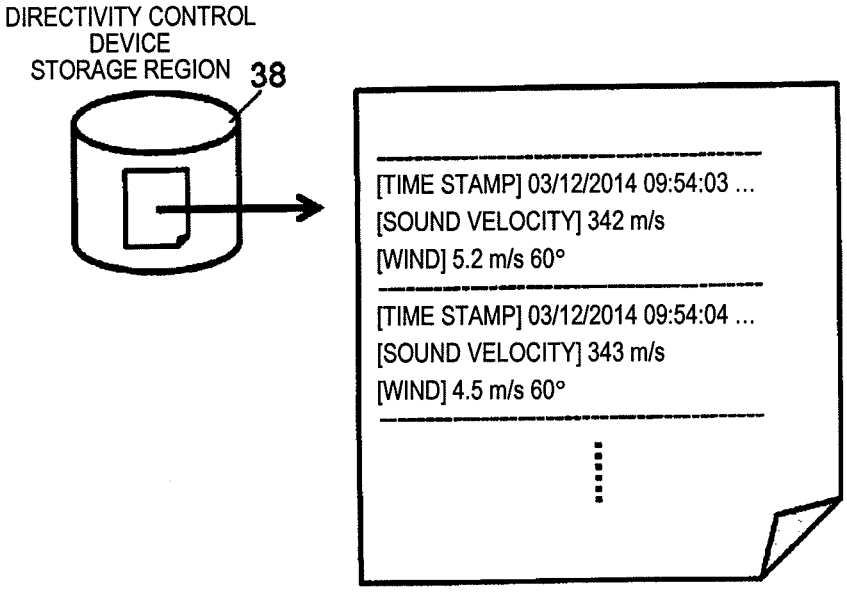
FIG. 21C is a diagram illustrating an example of data stored in a storage region of the directivity control device illustrated in FIG. 20.

FIG. 21A is a flow chart illustrating a tenth example of an operation procedure of directivity control device 3. FIG. 21B is a diagram illustrating an example of data stored in a recorder storage region of recorder device 4 illustrated in FIG. 20. FIG. 21C is a diagram illustrating an example of data stored in a storage region of directivity control device 3 illustrated in FIG. 20. In the description of FIG. 21A, the same operations as the operations in FIG. 7B are denoted by the same step numbers, a description thereof will be simplified or omitted, and different contents will be described.

In FIG. 21A, communicator 31 receives packet PKT (that is, sound data and a time stamp) which is transmitted from omnidirectional microphone array device 2 or recorder device 4 and outputs the received packet to signal processor 33 (S61).

Sound velocity corrector 34*b* extracts the time stamp acquired from communicator 31 in step S61 (S71). The sound velocity corrector acquires temperature data, humidity data, atmospheric pressure data, and data of wind direction and wind velocity which correspond to the time stamp from external database EXDB and reads out the acquired data (S72). Sound velocity corrector 34*b* calculates sound velocity Vs in accordance with Expression (4) to Expression (6) using the temperature data, the humidity data, and the atmospheric pressure data which are read out in step S72 (S15). Sound velocity corrector 34*b* stores sound velocity Vs calculated in step S15 in memory 38 (S52).

Further, sound velocity corrector 34*b* extracts the data of the wind direction and the wind velocity read out in step S72 (S73), and stores the data of the wind direction and the wind velocity in memory 38 (S54). Sound velocity corrector 34*b* corrects sound velocity Vs stored in memory 38 in step S52 to sound velocity Vs' in accordance with Expression (7) (S74). The operation subsequent to step S74 is the same as step S16 illustrated in FIG. 7B, and thus a description thereof will be omitted here.

As illustrated in FIG. 21B, in a recorder storage region of recorder device 4 according to the present exemplary embodiment, pieces of data transmitted from omnidirectional microphone array device 2 are a time stamp and sound data, and thus the sound data and the time stamp are stored in association with each other for each record.

As illustrated in FIG. 21C, in a storage region of memory 38 of directivity control device 3 according to the present exemplary embodiment, sound velocity Vs calculated in step S15 using data acquired from external database EXDB, data of wind direction and wind velocity acquired from external database EXDB, and a time stamp are stored. For this reason, the data of sound velocity Vs, the data of the wind direction and the wind velocity, and the time stamp are stored in association with each other for one record. Meanwhile, pieces of data stored in recorder device 4 and directivity control device 3 are associated with each other by a time stamp. Accordingly, when directivity control device 3 acquires sound data stored in recorder device 4 and outputs the acquired sound data from speaker device 37, the directivity control device acquires sound data having the same time stamp from recorder device 4.

As described above, in the ninth example of the calculation of sound velocity Vs, directivity control device 3 as an example of a sound velocity correction device according to the disclosure acquires measured values of environmental parameters corresponding to an installation position of omnidirectional microphone array device 2 from external database EXDB in which measured values of temperature data, humidity data, atmospheric pressure data, data of wind direction and wind velocity, which are environmental parameters, for each region are stored in association with a measurement date and time and a measurement time. Accordingly, it is possible to calculate an accurate sound velocity using measured values of surrounding environmental parameters during sound collection performed by omnidirectional microphone array device 2.

Although various exemplary embodiments have been described with reference to the accompanying drawings, it is needless to say that the disclosure is not limited to the examples. It is apparent that those skilled in the art can make various changes and modifications within the scope described in the claims, and it is understood that the changes and the modifications obviously belong to the technical scope of the disclosure.

The disclosure is useful as a sound velocity correction device that suppresses deterioration in directivity formation accuracy by acquiring at least ambient temperature, humidity, and atmospheric pressure during the collection of a sound emitted from a sound source in a specific direction when seen from a microphone array device and calculating an accurate sound velocity.

What is claimed is:

1. A sound collection directivity control system comprising:

a microphone array that collects a sound emitted from a sound source;

a sensor that measures an environmental parameter exposed to the microphone array; and a non-transitory computer readable recording medium that stores instructions, the instructions, when executed by a processor, causes the processor to perform operations including:

acquiring, from the sensor, a measured value of the environmental parameter exposed to the microphone array;

estimating, from a location of the sound source, a sound velocity of the collected sound, which is used to form sound directivity in a direction towards the sound source from the microphone array, using the measured value of the environmental parameter;

forming the sound directivity based on the estimated sound velocity of the collected sound;

adjusting a sound level of an audio signal to be output based on the sound directivity; and outputting the audio signal with the adjusted sound level in the direction of the sound source.

2. The sound collection directivity control system of claim 1, wherein a vent hole is provided on a housing that accommodates the microphone array, and wherein the sensor is disposed in a vicinity of the vent hole of the housing.

3. The sound collection directivity control system of claim 1, wherein the measured value of the environmental parameter which is measured by the sensor is corrected by a predetermined amount.

4. The sound collection directivity control system of claim 1, wherein the sound velocity is corrected using a predetermined reference value of the sound velocity calculated using the measured value of the environmental parameter measured by the sensor.

5. The sound collection directivity control system of claim 1, wherein the sensor periodically measures the environmental parameter, and wherein, when the measured value of the environmental parameter measured by the sensor has changed by a predetermined amount or more, the sound velocity is corrected using the changed measured value of the environmental parameter.

6. The sound collection directivity control system of claim 1, wherein the sensor periodically measures the environmental parameter, and wherein, when a predetermined period of time has elapsed after the sensor measures the environmental parameter, the sound velocity is corrected using the measured value of the environmental parameter measured by the sensor.

7. The sound collection directivity control system of claim 1, wherein the sensor periodically measures the environmental parameter, and wherein, when a difference between the measured value of the environmental parameter measured by the sensor and a predetermined setting value of the environmental parameter is less than a predetermined value, the sound velocity is corrected using an initial setting value of the environmental parameter.

8. The sound collection directivity control system of claim 1, wherein, when the measured value of the environmental parameter is input, the sound velocity is corrected using the input measured value of the environmental parameter.

9. The sound collection directivity control system of claim 1, wherein the measured value of the environmental parameter corresponding to an installation position of the microphone array is acquired from a database that stores the measured value of the environmental parameter for each region, and wherein the sound velocity is corrected using the measured value of the environmental parameter which is acquired from the database.

10. The sound collection directivity control system of claim 1, wherein the environmental parameter includes at least temperature among parameters including the temperature, humidity, and atmospheric pressure.

11. The sound collection directivity control system of claim 1, further comprising:

a wind sensor that measures a wind direction and a wind velocity exposed to the microphone array, wherein the sound velocity is corrected using the measured value of the environmental parameter measured by the sensor and measured values of the wind direction and the wind velocity which are measured by the wind sensor.

12. The sound collection directivity control system of claim 1, wherein the microphone array includes:

a plurality of microphones;

delay circuits, each of which connects to one of the plurality of the microphones and delays the audio signal output from the connected microphone; and an adder that adds outputs of the delay circuits, and wherein each of the delay circuits corrects a delay time based on the estimated sound velocity of the collected sound and a distance between the sound source and a microphone that correspondingly connects to one of the delay circuits.

13. A sound collection directivity control system comprising:

a microphone array that collects a sound emitted from a sound source;

a sensor that measures an environmental parameter exposed to the microphone array;

an input that receives a designated position;

a non-transitory computer readable recording medium storing instructions, the instructions, when executed by a processor, causing the processor to perform operations including:

receiving the designated position;

acquiring, from the sensor, a measured value of the environmental parameter exposed to the microphone array;

estimating, from the designated position, a sound velocity of the collected sound, which is used to form sound directivity in a direction towards the designated position from the microphone array, using the measured value of the environmental parameter;

forming the sound directivity based on the estimated sound velocity of the collected sound;

adjusting a sound level of an audio signal to be output based on the sound directivity; and outputting the audio signal with the adjusted sound level in the direction of the sound source based on the sound directivity.

14. The sound collection directivity control system of claim 13, wherein the microphone array includes:

a plurality of microphones;

delay circuits, each of which connects to one of the plurality of the microphones and delays the signal output from the connected microphone; and an adder that adds outputs of the delay circuits; and wherein each of the delay circuits corrects delay time based on the estimated sound velocity of the collected sound and a distance between the designated position and a microphone that correspondingly connects to one of the delay circuits.

* * * * *